US012146255B2

(12) United States Patent
Bueno et al.

(10) Patent No.: US 12,146,255 B2
(45) **Date of Patent: *Nov. 19, 2024**

(54) LAUNDRY TREATING APPLIANCE HAVING A BULK DISPENSING ASSEMBLY

(71) Applicant: WHIRLPOOL CORPORATION, Benton Harbor, MI (US)

(72) Inventors: Rommy Mariana Bueno, Guadalupe (MX); Ndjeka K. Luhahi, Grand Rapids, MI (US); Eric G. Griswold, Saint Joseph, MI (US); Joel Aldebaran Salazar, Monterrey (MX); Dennis Kehl, Benton Harbor, MI (US); Alejandro Guzman, Monterrey (MX); Steven Key, Stevensville, MI (US); Ryan James Van Zoest, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 519 days.

This patent is subject to a terminal disclaimer.

(21) Appl. No.: 17/491,848

(22) Filed: Oct. 1, 2021

(65) Prior Publication Data

US 2022/0018053 A1 Jan. 20, 2022

Related U.S. Application Data

(60) Continuation of application No. 17/038,543, filed on Sep. 30, 2020, now Pat. No. 11,162,207, which is a (Continued)

(51) Int. Cl.
*D06F 39/02* (2006.01)
*D06F 33/43* (2020.01)
(Continued)

(52) U.S. Cl.
CPC ..... *D06F 33/48* (2020.02); *D06F 33/43* (2020.02); *D06F 33/69* (2020.02); *D06F 34/28* (2020.02);
(Continued)

(58) Field of Classification Search
CPC ..... D06F 33/48
See application file for complete search history.

(56) References Cited

U.S. PATENT DOCUMENTS 3,258,792 A 7/1966 Rickel
3,658,398 A 4/1972 Abbate, Jr.
(Continued)

FOREIGN PATENT DOCUMENTS

DE 8308458 U1 12/1983
DE 102009030288 A1 1/2010
(Continued)

OTHER PUBLICATIONS

European Search Report for Counterpart EP18198894.0, Dated Mar. 1, 2019.

*Primary Examiner* — Jason Y Ko
(74) *Attorney, Agent, or Firm* — McGarry Bair PC

(57) ABSTRACT

A laundry treating appliance includes a cabinet defining an interior. A drum is located within the interior and defines a treating chamber. The laundry treating appliance includes a recirculation circuit including a recirculation pump having an inlet and an outlet. The laundry treating appliance further includes a bulk treating chemistry dispenser. A method for rinsing or cleaning the bulk treating chemistry dispenser can be included.

20 Claims, 23 Drawing Sheets

Related U.S. Application Data division of application No. 16/115,023, filed on Aug. 28, 2018, now Pat. No. 10,815,605.

(60) Provisional application No. 62/616,587, filed on Jan. 12, 2018, provisional application No. 62/568,968, filed on Oct. 6, 2017.

(51) Int. Cl.

| | |
|---|---|
| ***D06F 33/48*** | (2020.01) |
| ***D06F 33/69*** | (2020.01) |
| ***D06F 34/28*** | (2020.01) |
| ***D06F 39/08*** | (2006.01) |
| *D06F 34/24* | (2020.01) |
| *D06F 35/00* | (2006.01) |
| *D06F 39/12* | (2006.01) |
| *D06F 103/38* | (2020.01) |
| *D06F 103/70* | (2020.01) |
| *D06F 105/60* | (2020.01) |

(52) U.S. Cl.

CPC ..... *D06F 39/022* (2013.01); *D06F 39/085* (2013.01); *D06F 34/24* (2020.02); *D06F 35/008* (2013.01); *D06F 39/083* (2013.01); *D06F 39/087* (2013.01); *D06F 39/12* (2013.01); *D06F 2103/38* (2020.02); *D06F 2103/70* (2020.02); *D06F 2105/60* (2020.02)

(56) References Cited

U.S. PATENT DOCUMENTS

| | | | |
|---|---|---|---|
| 3,747,802 | A | 7/1973 | Uroshevich |
| 3,929,387 | A | 12/1975 | Grass |
| 4,037,885 | A | 7/1977 | Rock |
| 4,227,750 | A | 10/1980 | Rock |
| 4,647,225 | A | 3/1987 | Grass |
| 4,811,875 | A | 3/1989 | DiSimone |
| 5,056,879 | A | 10/1991 | Rock |
| 6,109,480 | A | 8/2000 | Monsrud |
| 6,378,963 | B1 | 4/2002 | Relyea |
| 6,401,968 | B1 | 6/2002 | Huang |
| 6,494,551 | B1 | 12/2002 | Markley |
| 7,044,569 | B1 | 5/2006 | Relyea |
| 8,006,522 | B2 | 8/2011 | Kim |
| 8,052,805 | B2 | 11/2011 | Hendrickson |
| 8,056,374 | B2 | 11/2011 | Hoppe |
| 8,246,756 | B2 | 8/2012 | Hendrickson |
| 8,449,210 | B2 | 5/2013 | Noguchi |
| 8,505,341 | B2 | 8/2013 | Hendrickson |
| 8,584,492 | B2 | 11/2013 | Seo |
| 8,839,648 | B2 | 9/2014 | Je |
| 8,850,856 | B2 | 10/2014 | Leibman |
| 8,863,340 | B2 | 10/2014 | Schulze |
| 9,133,576 | B2 | 9/2015 | Lee |
| 9,167,897 | B2 | 10/2015 | Barnes |
| 9,217,218 | B2 | 12/2015 | Kim |
| 9,447,536 | B2 | 9/2016 | Tincher |
| 9,528,216 | B2 | 12/2016 | Jo |
| 9,534,339 | B2 | 1/2017 | Leibman |
| 2004/0104649 | A1 | 6/2004 | Muller |
| 2006/0107705 | A1 | 5/2006 | Hsu et al. |
| 2010/0161143 | A1 | 6/2010 | Smith |
| 2012/0164283 | A1 | 6/2012 | Kissner |
| 2013/0086754 | A1 | 4/2013 | Hendrickson et al. |
| 2014/0102153 | A1 | 4/2014 | Lee |
| 2015/0252513 | A1 | 9/2015 | Seo |
| 2016/0289883 | A1 | 10/2016 | Lv |
| 2017/0107656 | A1 | 4/2017 | Kim |
| 2017/0159221 | A1 | 6/2017 | Cho |
| 2017/0159223 | A1 | 6/2017 | Alexander et al. |
| 2017/0166362 | A1 | 6/2017 | Kalmanides |

FOREIGN PATENT DOCUMENTS

| | | | |
|---|---|---|---|
| DE | 102013015463 | A1 | 2/2015 |
| EP | 0699405 | A1 | 3/1996 |
| EP | 0860141 | A2 | 8/1998 |
| EP | 1323548 | A2 | 7/2003 |
| EP | 1884584 | A2 | 2/2008 |
| EP | 1956263 | A1 | 8/2008 |
| EP | 2642014 | A1 | 9/2013 |
| EP | 2784205 | A1 | 10/2014 |
| EP | 2794980 | B1 | 11/2015 |
| EP | 2126185 | B1 | 6/2016 |
| GB | 929782 | A | 6/1963 |
| GB | 1419861 | A | 12/1975 |
| KR | 200282602 | Y1 | 7/2002 |
| KR | 20140145751 | A | 12/2014 |
| WO | 2008120930 | A2 | 10/2008 |
| WO | 2016102013 | A1 | 6/2016 |

LAUNDRY TREATING APPLIANCE HAVING A BULK DISPENSING ASSEMBLY

CROSS-REFERENCE TO RELATED APPLICATIONS

This application is a continuation of U.S. patent application Ser. No. 17/038,543, filed Sep. 30, 2020, now U.S. Pat. No. 11,162,207, issued Nov. 2, 2021, which is a divisional application of U.S. patent application Ser. No. 16/115,023, filed Aug. 28, 2018, now U.S. Pat. No. 10,815,605, issued on Oct. 27, 2020, which claims the benefit of U.S. Provisional Patent Application No. 62/568,968, filed on Oct. 6, 2017, and U.S. Provisional Patent Application No. 62/616,587, filed on Jan. 12, 2018, all of which are incorporated herein by reference in their entireties.

BACKGROUND

Laundry treating appliances, such as clothes washers, refreshers, and non-aqueous systems, can have a configuration based on a rotating drum that at least partially defines a treating chamber in which laundry items are placed for treating. The laundry treating household appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. The laundry treating household appliance can have a dispenser for loading of treating chemistries into the appliance by the user and for supplying various treating chemistries to the treating chamber.

BRIEF DESCRIPTION

In one aspect, the present disclosure relates to a method of rinsing or cleaning of a bulk treating chemistry dispenser for a laundry treating appliance, the method comprising monitoring an operation of the laundry treating appliance, determining by a controller that a rinse or cleaning cycle for the bulk treating chemistry dispenser is due, and prompting a user to add rinsing liquid to at least one treating chemistry reservoir contained within the bulk treating chemistry dispenser.

DETAILED DESCRIPTION

Aspects of the disclosure relate to a bulk dispensing assembly for a laundry treating appliance. Laundry treating appliances can be provided with both single dose dispensers and bulk dispensing assemblies. Laundry treating appliances can have unused space within a lower portion of the cabinet, below the drum and the treating chamber. This space can be efficiently used as a location for a bulk dispensing assembly to allow for the storage of large quantities of treating chemistries that can be dispensed on a load-by-load basis.

One way of incorporating such a bulk dispensing assembly into a lower portion of the cabinet of the laundry treating appliance is to provide the bulk dispensing assembly as a drawer that is located below the treating chamber. A user can withdraw the drawer from the cabinet, and then check or fill the reservoir or reservoirs either in place within the drawer, or, in the case that the reservoirs are removably contained within the drawer, can withdraw the reservoirs so that they can be filled at a convenient height for the user, such as on a countertop.

To provide a more positive user experience, the drawer can have a rail assembly for withdrawal of the drawer that can support the weight of large quantities of treating chemistries, which can be liquids, as well as a drawer that withdraws smoothly and has structures that provide improved usability, such as stops to ensure the drawer is not inadvertently removed, smooth and even withdrawal, and features that allow the drawer to be removed completely for, by way of non-limiting example, cleaning of the drawer or access to parts of the laundry treating appliance behind the drawer for maintenance or cleaning.

Additional features of a bulk dispensing assembly that can improve a user experience include the design of the reservoirs, ease of filling the reservoirs, the design of the drawer for containing the reservoirs, and the docking structures and pumps associated with the bulk dispensing assembly that permit a user to fill the bulk dispensing assembly less frequently than required by a traditional dispenser. A method can also be provided for rinsing the reservoirs of the bulk dispensing assembly to ensure that residues are not present within the reservoirs.

Figure 1:
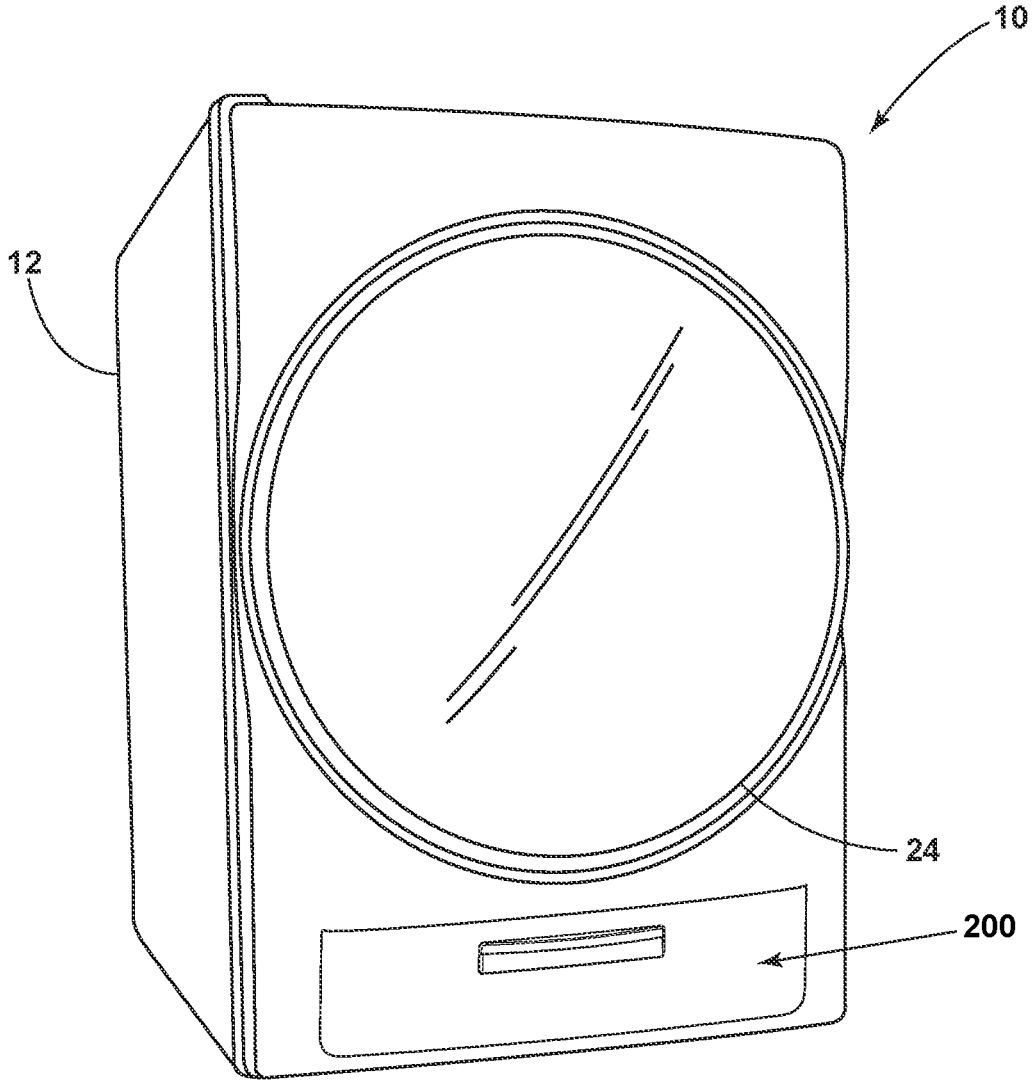
FIG. 1 illustrates a perspective view of a laundry treating appliance according to an aspect of the present disclosure.

In more detail, and referring to FIG. 1, a laundry treating appliance 10 according to an aspect of the disclosure can be any laundry treating appliance 10 that performs a cycle of operation to clean or otherwise treat laundry items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations.

Washing machines are typically categorized as either a vertical axis washing machine or a horizontal axis washing machine. The terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary laundry treating appliance 10 of FIG. 1 is a horizontal axis washing machine.

The laundry treating appliance 10 can include a structural support assembly comprising a cabinet 12 defining a housing within which a laundry holding assembly resides. The cabinet 12 can be a housing having a chassis and/or a frame, to which decorative panels can or cannot be mounted, defining an interior, enclosing components typically found in a conventional washing machine. Such components are not described in detail, but are described briefly as needed to provide an illustrative environment to support a complete understanding of aspects of the present disclosure.

Figure 2:
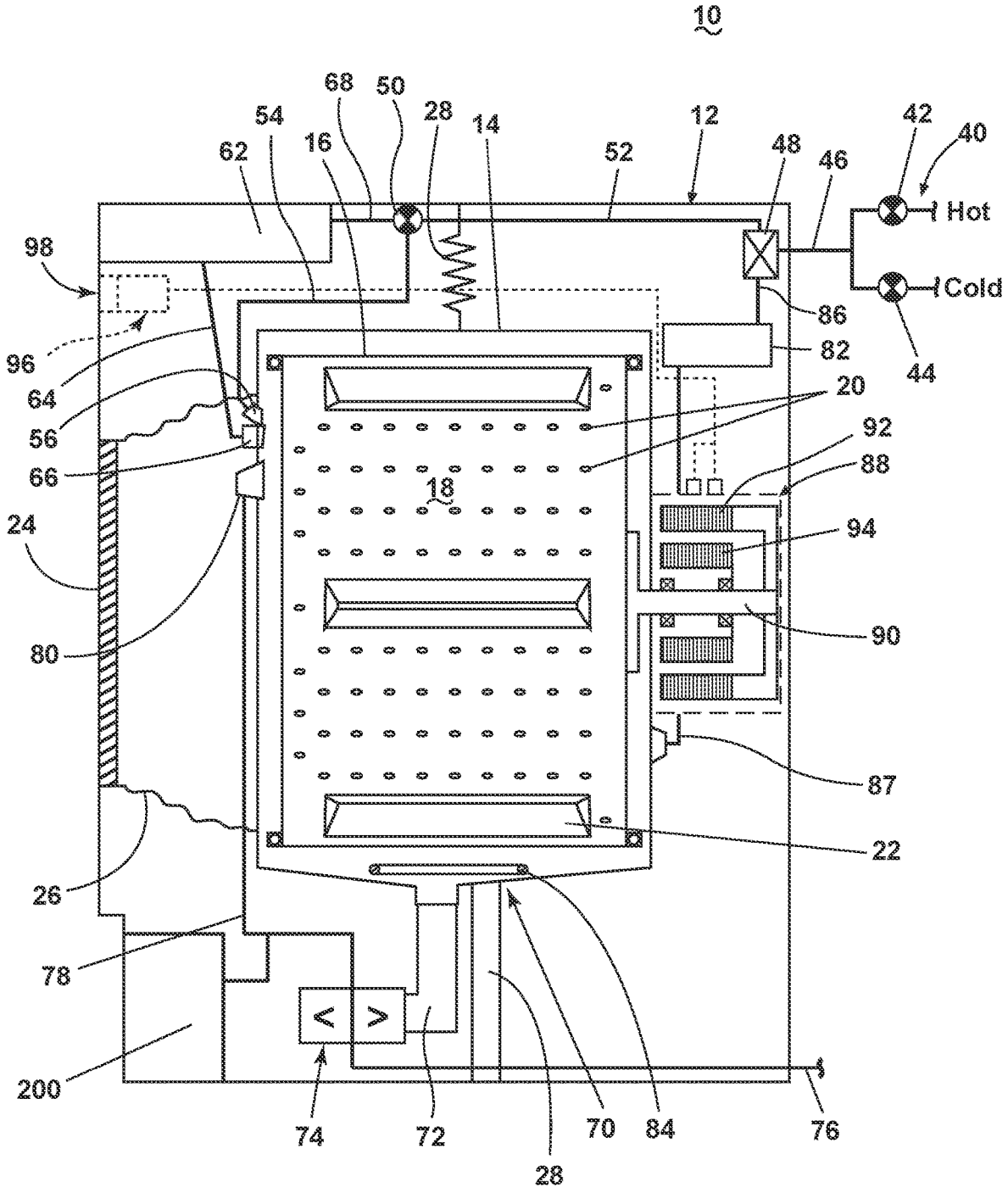
FIG. 2 illustrates a schematic cross-sectional view of the laundry treating appliance of FIG. 1 in the form of a washing machine according to an aspect of the present disclosure.

Referring now to FIG. 2, the laundry holding assembly may include a rotatable drum 16 supported within the cabinet 12 by a suitable suspension assembly and defining at least a portion of a laundry treating chamber 18 for receiving the laundry and which rotates about a generally horizontal axis. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. An access opening of the cabinet 12 provides access to the laundry treating chamber 18. A door 24 can be movably mounted to the cabinet 12 to selectively close the access opening to the treating chamber 18. The cabinet 12 can also include a bulk dispensing assembly 200, which can be implemented as a drawer that is at least partially withdrawable from the cabinet 12. While the bulk dispensing assembly 200 is illustrated herein as a withdrawable drawer, it will also be understood that the bulk dispensing assembly 200 can be pivotably withdrawable about either a horizontal axis, in a tilt-out style, or a vertical axis, in a swing-out door style.

Figure 4:
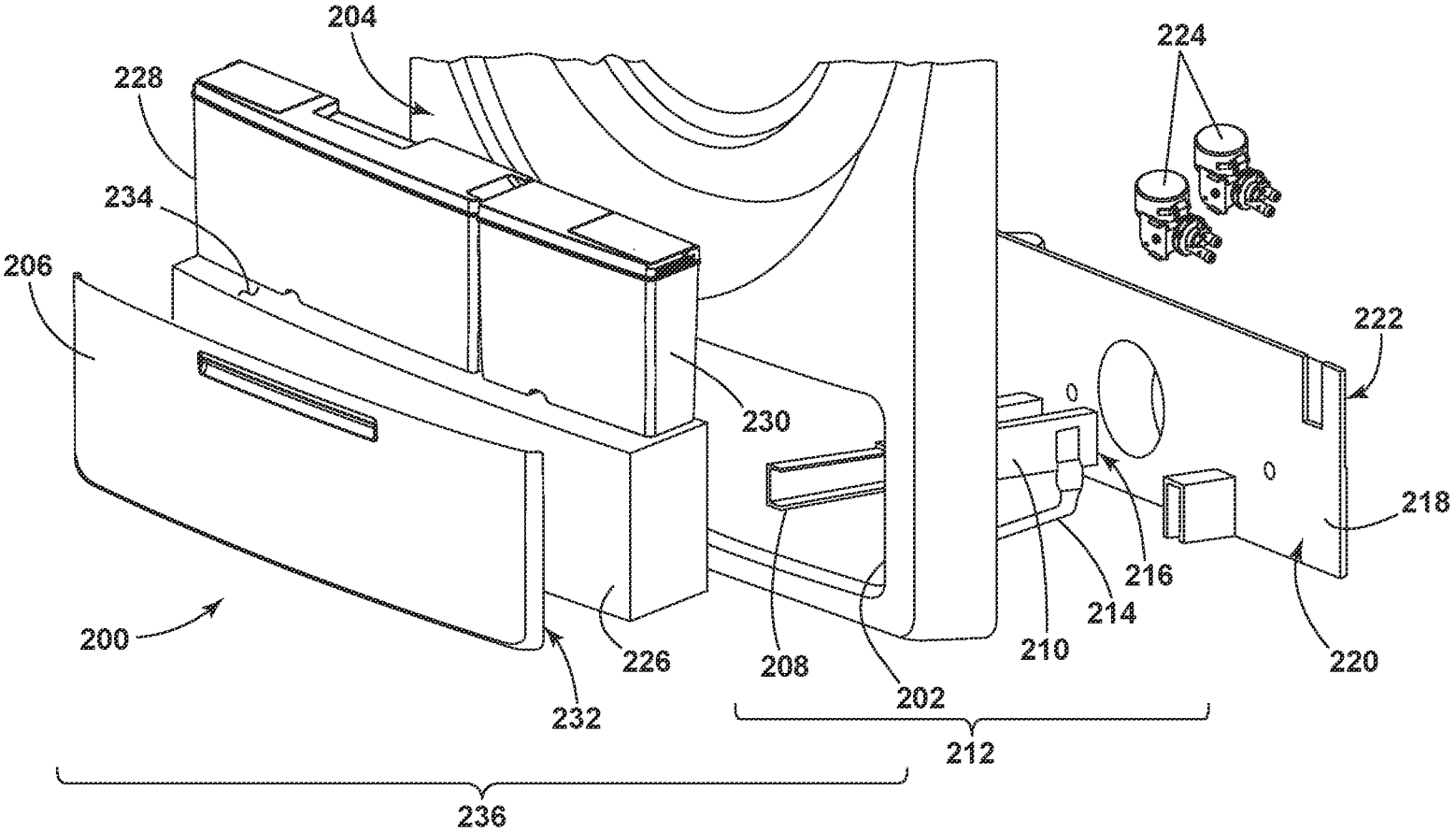
FIG. 4 illustrates an exploded view of a bulk dispensing assembly for use with the laundry treating appliance of FIG. 1 according to an aspect of the present disclosure.

FIG. 4 illustrates an exploded view of the bulk dispensing assembly 200 according to an aspect of the present disclosure. The cabinet 12 includes a bulk dispensing opening 202. In an exemplary aspect, the bulk dispensing opening 202 is formed within a front panel 204 of the cabinet 12, below the door 24 and the treating chamber 18, but it will be understood that the bulk dispensing opening 202 can be provided at any suitable location within the cabinet 12, including above the door 24, beside the door 24, or on a side or a top surface of the cabinet 12. A front fascia 206 can be received within the bulk dispensing opening 202 when the bulk dispensing assembly 200 is fully received within the cabinet 12. The front fascia 206 can be coupled to a drawer rail 208. The drawer rail 208 can be slidingly received within a cabinet rail 210. The cabinet rail 210 can be coupled to the cabinet 12 via a rail support 214 that can additionally provide structural support for the cabinet rail 210. The drawer rail 208, the cabinet rail 210, and the rail support 214 can be collectively thought of as a drawer rail assembly 212. A rear end 216 of the cabinet rail 210 can be coupled to a drawer backer 218, and more specifically to a front surface 220 of the drawer backer 218.

A drawer liner 226 can be coupled to a rear surface 232 of the front fascia 206. The drawer liner 226 defines a receiving space 234 for the bulk dispensing assembly 200. Treating chemistry reservoirs 228, 230 can be received within the receiving space 234 of the drawer liner 226 for the storage of treating chemistries. The front fascia 206, the drawer liner 226, the treating chemistry reservoirs 228, 230, and the drawer rail 208 can be collectively thought of as comprising a bulk dispensing drawer 236, which is slidably withdrawable from the cabinet 12. Non-limiting examples of treating chemistries that can be stored within the treating chemistry reservoirs 228, 230 include one or more of the following: detergents, soaps, fabric softening agents, bleach, water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

While the drawer liner 226 is illustrated herein as receiving two treating chemistry reservoirs 228, 230, it will be understood that any suitable number of treating chemistry reservoirs 228, 230 can be included. By way of non-limiting example, only a single treating chemistry reservoir 228 can be included that is sized to fill the drawer liner 226, or three or more treating chemistry reservoirs 228, 230 can be included, whether they are all equal in volume or whether they all have different volumes.

Additionally, the contents or the type of treating chemistry stored within the treating chemistry reservoirs 228, 230 can be a parameter defined by the laundry treating appliance 10, or it can be a user-selectable variable. By way of non-limiting example, the laundry treating appliance 10 can be programmed via a controller 96 (FIG. 3) to recognize the first treating chemistry reservoir 228 as being designated for a detergent, while the second treating chemistry reservoir 230 can be designated for containing a fabric softener. Alternately, a user can instruct the controller 96 as to what is contained in the treating chemistry reservoirs 228, 230 by entering such information into a user interface 98. By way of non-limiting example, a user can input information to the user interface 98 indicating that the first treating chemistry reservoir 228 contains a detergent while the second treating chemistry reservoir 230 contains a fabric softener or a stain treating chemistry, or that both treating chemistry reservoirs 228, 230 contain a detergent, or any desired combination.

Based on information received by or programmed into the controller 96 as to the contents of the treating chemistry reservoirs 228, 230, the controller 96 can determine an appropriate amount of a treating chemistry from one or more of the treating chemistry reservoirs 228, 230 that should be taken from the bulk dispensing assembly 200 at a predetermined appropriate point during an automatic cycle of operation, and the controller 96 can control the operation of metering pumps 224 accordingly to remove the appropriate amount of the treating chemistry from at least one of the treating chemistry reservoirs 228, 230 at the appropriate time. In an exemplary aspect, the metering pumps 224 can be coupled to a rear surface 222 of the drawer backer 218, although it will be understood that the metering pumps 224 can be positioned at any suitable location within the cabinet 12, including being coupled to the cabinet 12 itself, or coupled to a component of a liquid supply assembly of the laundry treating appliance 10.

Figure 5:
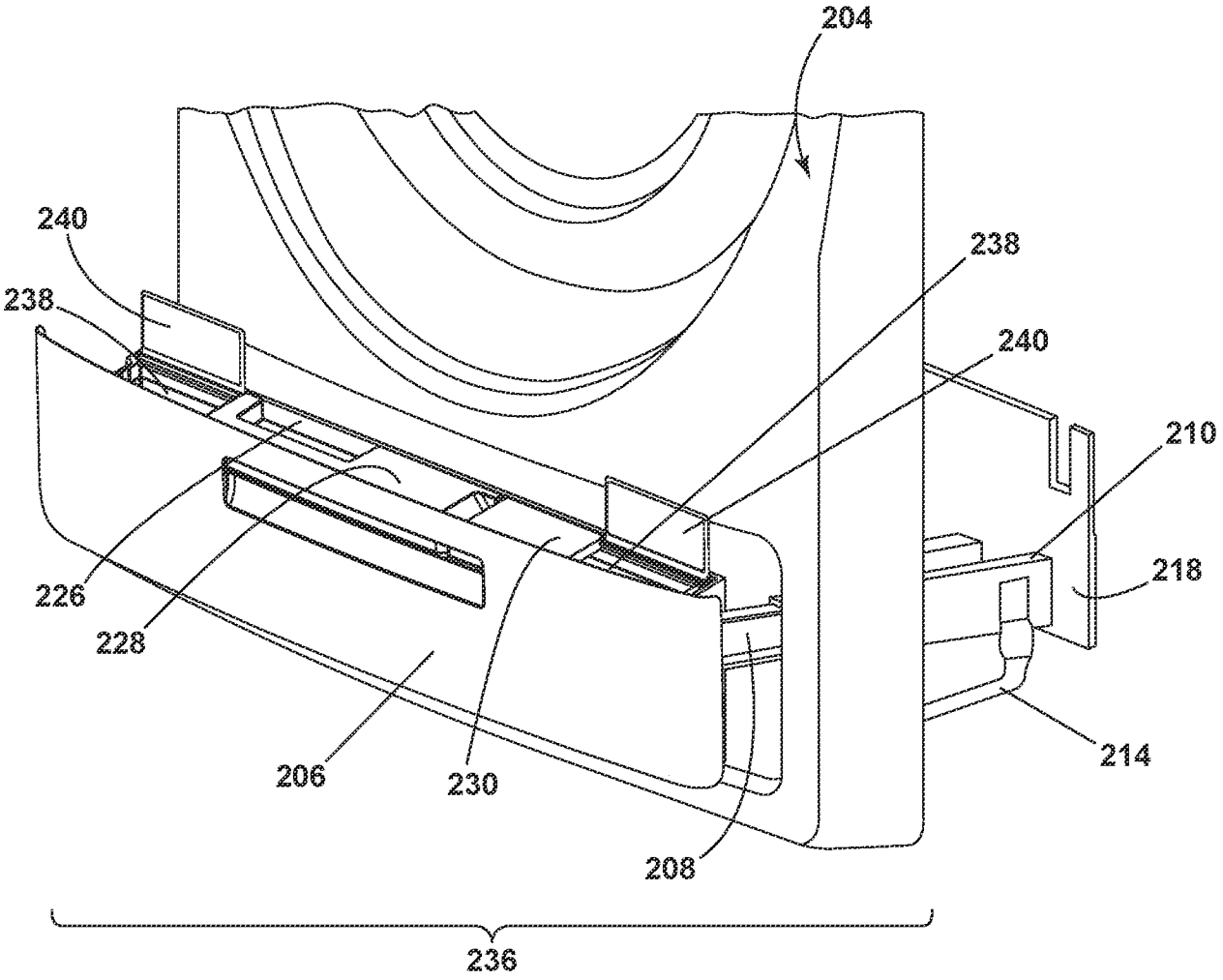
FIG. 5 illustrates a front perspective view of the bulk dispensing assembly of FIG. 4 with a bulk dispensing drawer in an opened condition according to the present disclosure.

FIG. 5 illustrates a front perspective view of the bulk dispensing assembly 200 in an assembled form wherein the bulk dispensing drawer 236 is in an opened condition and is at least partially withdrawn from the cabinet 12. When the bulk dispensing drawer 236 is at least partially withdrawn from the cabinet 12, the treating chemistry reservoirs 228, 230 are accessible to a user. The treating chemistry reservoirs 228, 230 can have filling openings 238 on their top surfaces to allow for a treating chemistry to be poured into the treating chemistry reservoirs 228, 230. Lids 240 can also be provided to selectively open or close the filling openings 238. While the lids 240 are illustrated herein as being pivotably or hingedly attached to the treating chemistry reservoirs 228, 230, it will be understood that any suitable style of lid 240 can be used, including a snap-on lid, a screw-on lid, or a plug style closure.

Figure 6:
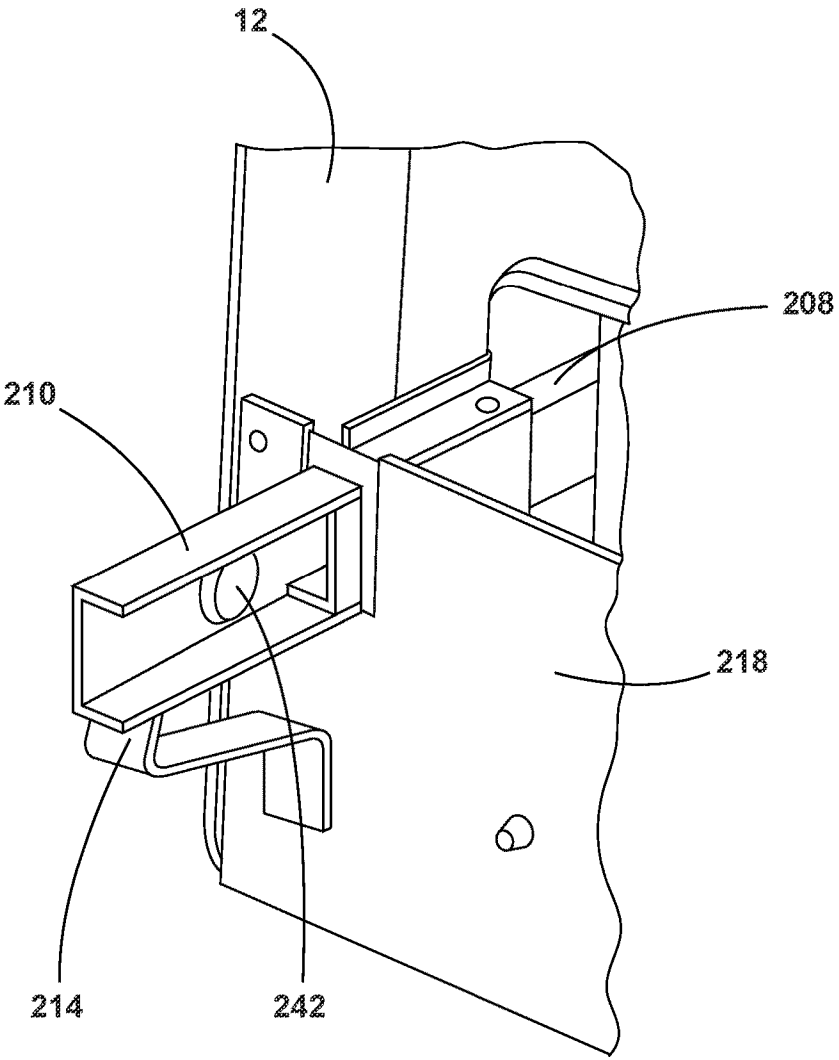
FIG. 6 illustrates a rear perspective view of the bulk dispensing assembly of FIG. 4 according to the present disclosure.

FIG. 6 illustrates a rear perspective view of the bulk dispensing assembly 200 in an assembled form in order to better illustrate additional features of the rail assembly 212. The rail assembly 212 can further comprise at least one roller 242. The at least one roller 242 can be positioned within and coupled to the cabinet rail 210. The at least one roller 242 can serve to aid in the smoothness of the withdrawal of the bulk dispensing drawer 236 by allowing the drawer rail 208 to slide more smoothly within the cabinet rail 210. It will be understood that any suitable number of rollers can be provided at any suitable position within the cabinet rail 210 or the drawer rail 208. The cabinet rail 210, the drawer rail 208, and the at least one roller 242 can be formed from any suitable material, non-limiting examples of which include plastics or metals, and can be used with or without a lubricant or a grease within the rail assembly 212.

In addition, while a roller 242 is illustrated herein, it will be understood that a variety of structures can be used to aid in improving the smoothness of gliding of the rail assembly 212, whether it be adjacent the cabinet rail 210, or the drawer rail 208, or both, non-limiting examples of which include wheels, bearings, bushings, gears, and glides. In one contemplated aspect, for example, both the cabinet rail 210 and the drawer rail 208 can be formed of metal. In an exemplary aspect, both the cabinet rail 210 and the drawer rail 208 can be formed specifically of steel, with a plurality of bearings, which can be ball bearings, provided between the cabinet rail 210 and the drawer rail 208, such that the drawer rail 208 glides on top of the ball bearings.

Additionally, in any contemplated aspect of the rail assembly 212, additional features to improve usability and user experience with the bulk dispensing drawer 236 can be included. Non-limiting examples of such features of the rail assembly 212 include the provision of dampeners to prevent a hard stop, either when the bulk dispensing drawer 236 reaches the point where it is fully withdrawn from the cabinet 12 or when it is fully received within the cabinet 12, including a soft close damper or hydraulic damper, the provision of a stop feature to limit withdrawal of the bulk dispensing drawer 236 from the cabinet 12 such that it cannot be inadvertently withdrawn too far, a quick connect or quick release assembly to enable full removal of the bulk dispensing drawer 236 once it has reached the fully open condition in order for maintenance or service to be performed or to allow a user to clean, maintain, change, or access a filter, the provision of the rail assembly 212 at an angle, such that the bulk dispensing drawer 236 can automatically close, and a damper to pull in the bulk dispensing drawer 236 to a fully closed condition once it is nearly fully received within the cabinet 12.

Figure 7:
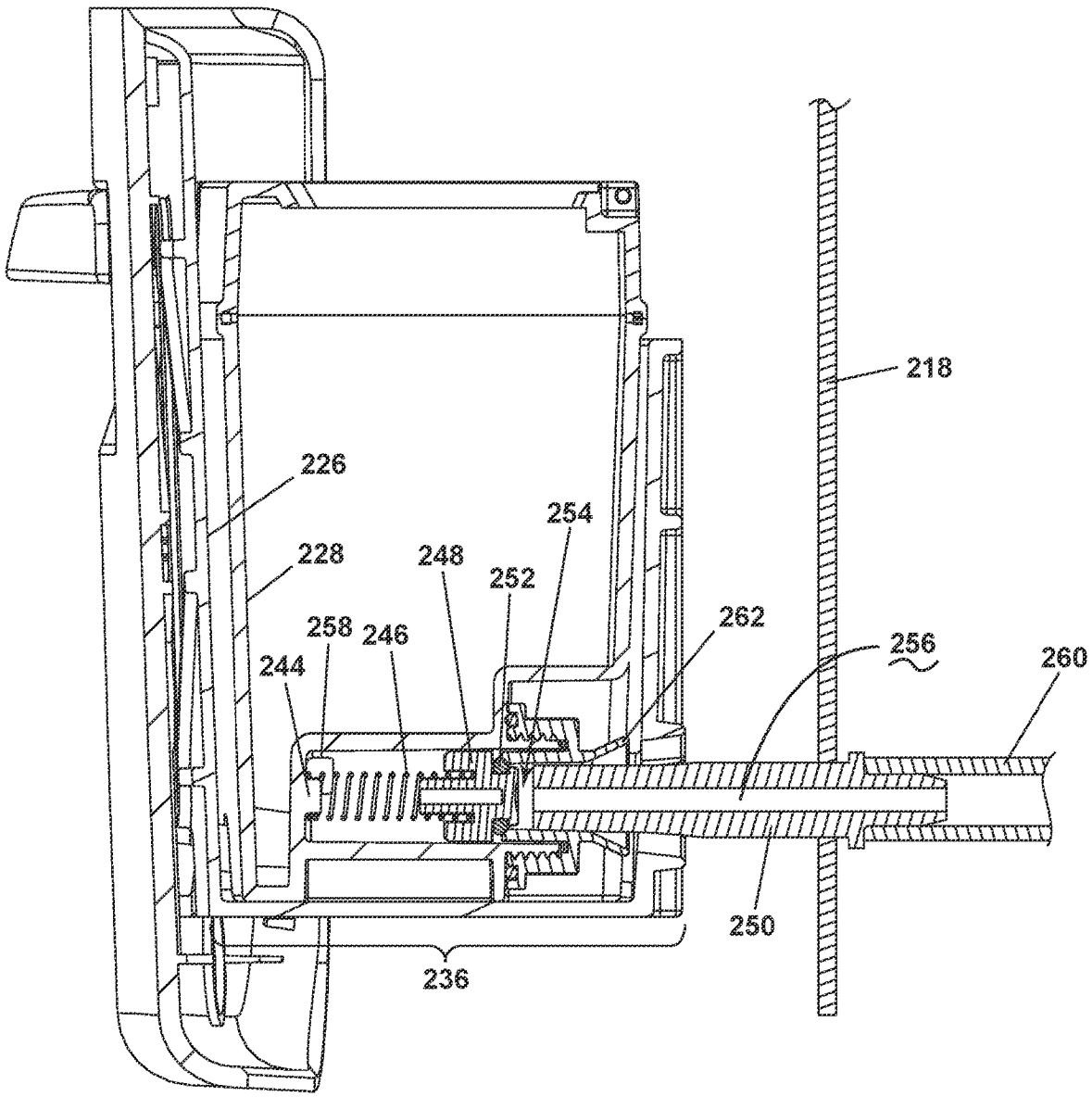
FIG. 7 illustrates a cross-sectional view of the bulk dispensing assembly of FIG. 4 with the bulk dispensing drawer in an opened condition.

FIG. 7 illustrates a cross-sectional view of the bulk dispensing assembly 200 in which the docking of the treating chemistry reservoir 228 can be more clearly seen. In FIG. 7, the bulk dispensing drawer 236 is in an opened condition, at least partially withdrawn from the cabinet 12. A docking plunger 250 is coupled to the drawer backer 218 such that the docking plunger 250 is stationary relative to the drawer backer 218. The docking plunger 250 defines a liquid passage 256 in its interior. A fluid opening 254 is located at the end of the docking plunger 250 that is nearest the bulk dispensing drawer 236. The end of the docking plunger 250 that is the furthest from the bulk dispensing drawer 236 is fluidly coupled to the metering pump 224 via a conduit 260.

The treating chemistry reservoir 228 includes a plunger opening 252. When the bulk dispensing drawer 236 is withdrawn from the cabinet 12, a plug 248 is biased against the plunger opening 252 by way of a spring 246, such that the plug 248 sealingly closes off the plunger opening 252 and prevents any treating chemistry that has come through a treating chemistry opening 258 and towards the plunger opening 252 from flowing through the plunger opening 252. A spring base 244 formed within the treating chemistry reservoir 228 holds the spring 246 in place so that it can bias the plug 248 against the plunger opening 252. The drawer liner 226 includes a liner opening 262 that is aligned with the plunger opening 252 when the treating chemistry reservoir 228 is fully seated within the drawer liner 226. When the bulk dispensing drawer 236 is withdrawn from the cabinet 12, the docking plunger 250 does not contact the plug 248.

Figure 8:
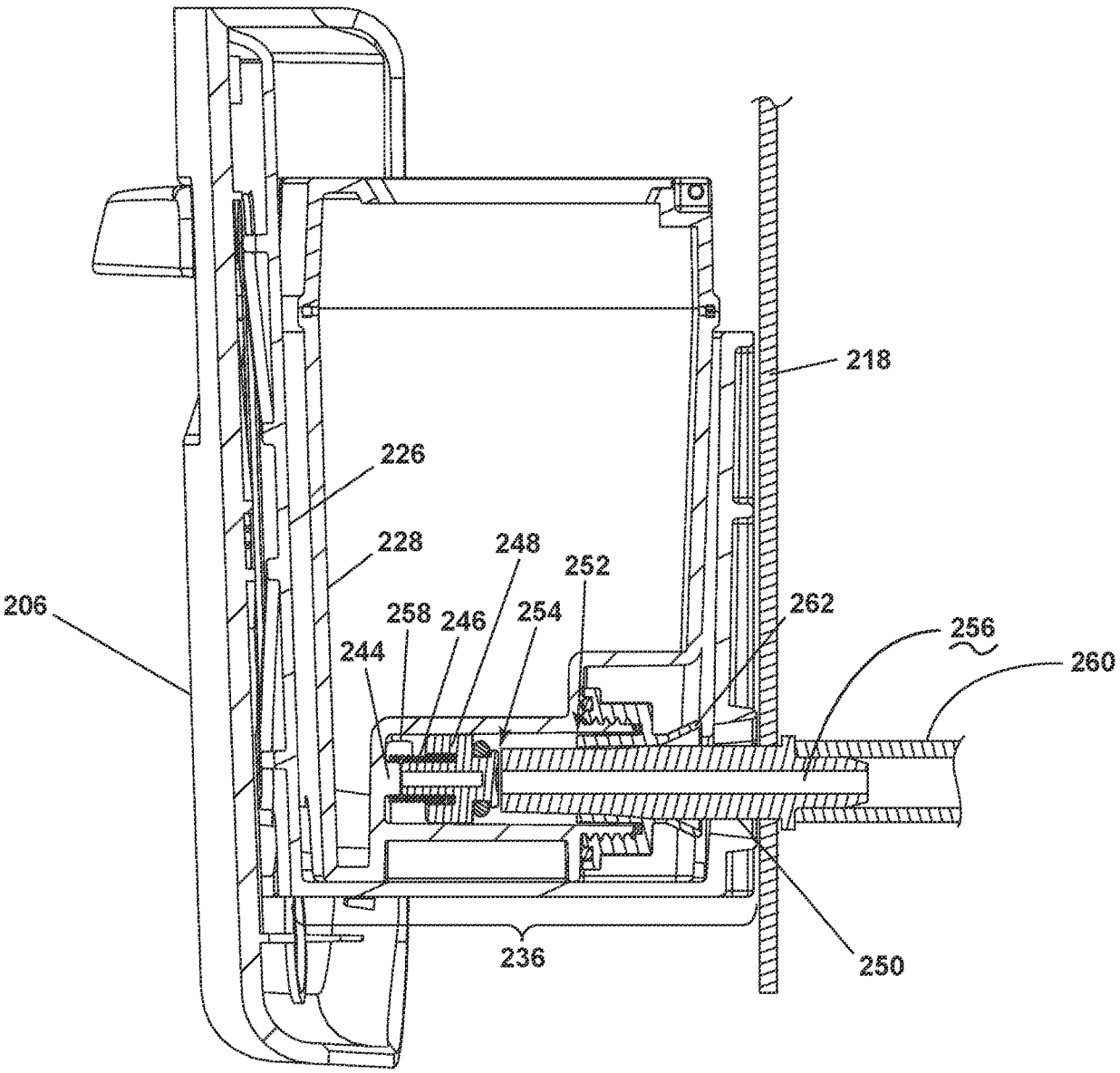
FIG. 8 illustrates the cross-sectional view of FIG. 7 with the bulk dispensing drawer in a closed condition.

FIG. 8 illustrates the cross-sectional view of FIG. 7, but with the bulk dispensing drawer 236 in a closed condition, such that the bulk dispensing drawer 236 is fully received within the cabinet 12 and is positioned such that it abuts or nearly abuts the drawer backer 218. When the bulk dispensing drawer 236 is in the closed condition, the docking plunger 250 is pressed against the plug 248 such that the force of the spring 246 is overcome and the docking plunger 250 biases the plug 248 out of the plunger opening 252. With the docking plunger 250 then inserted into the treating chemistry reservoir 228, the liquid can flow through the treating chemistry opening 258, through the fluid opening 254, and into the liquid passage 256. Liquid can then reach the metering pump 224 via the conduit 260. In an exemplary aspect, the plunger opening 252 forms a sealing engagement with the docking plunger 250 such that liquid cannot escape between the docking plunger 250 and the plunger opening 252, but rather only flows through the docking plunger 250 via the liquid passage 256.

Figure 9:
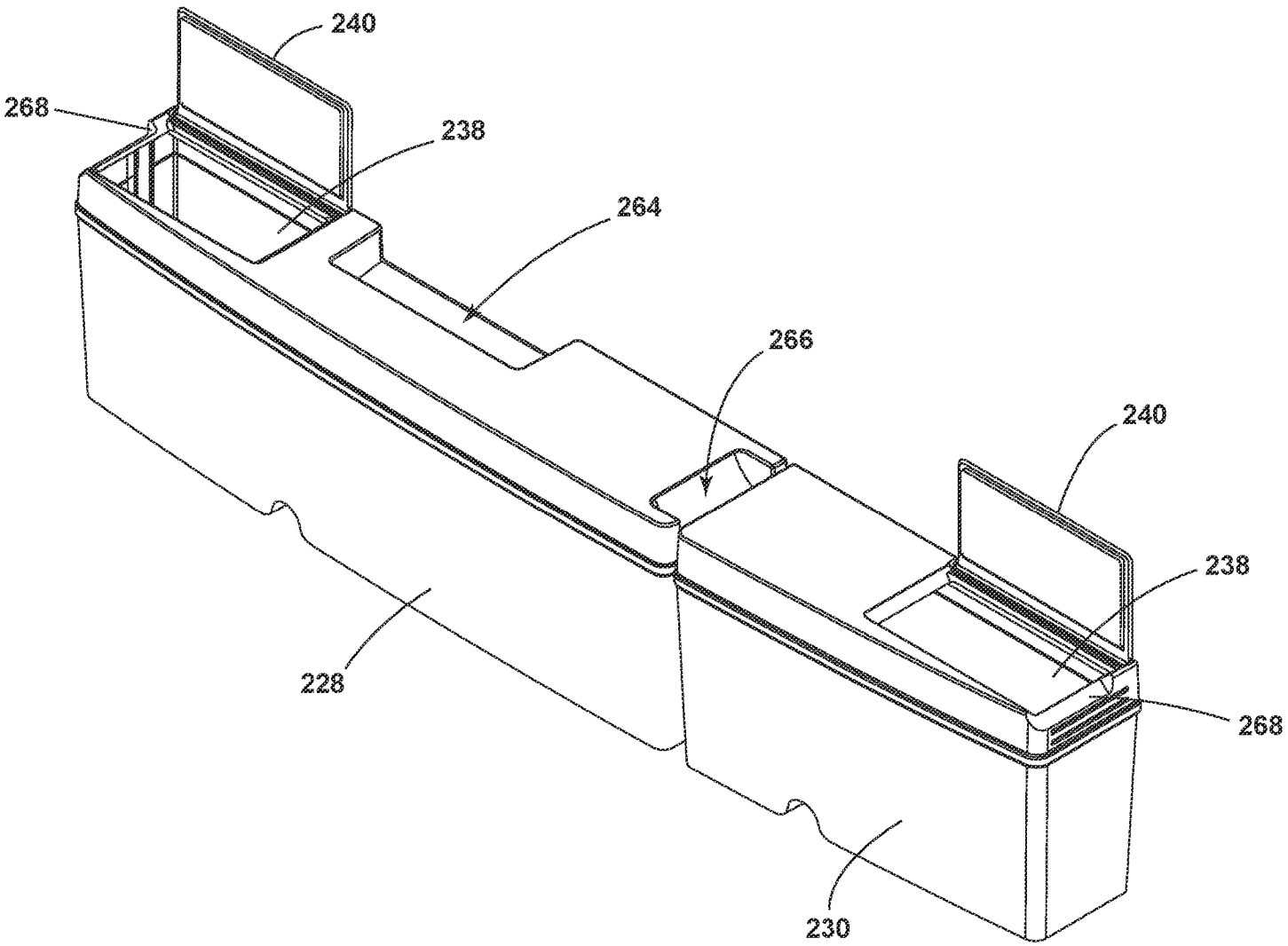
FIG. 9 illustrates a front perspective view of treating chemistry reservoirs for use with the bulk dispensing assembly of FIG. 4 according to the present disclosure.

FIG. 9 illustrates a front perspective view of the treating chemistry reservoirs 228, 230, with the lids 240 in an opened condition, allowing access to the filling openings 238. In an exemplary aspect, the filling openings 238 can be the same size or nearly as large as the area of the lid 240, in order to allow plenty of room for a user to pour the treating chemistry into the treating chemistry reservoir 228, 230. This results in a lower likelihood of spilling the treating chemistry or missing the filling opening 238 than with a smaller filling opening 238. The treating chemistry reservoirs 228, 230 can be transparent to allow a user to observe the contents easily through the side of the treating chemistry reservoirs 228, 230, or the treating chemistry reservoirs 228, 230 can be opaque, such that the contents are visible through the filling opening 238 instead.

The treating chemistry reservoirs 228, 230 further include structures for ease of removal from the drawer liner 226. In an exemplary aspect, at least one of the treating chemistry reservoirs 228, 230 can include a handle 264 formed into the treating chemistry reservoir 228, 230 such that a user can easily grip the handle 264 and pull the treating chemistry reservoir 228, 230 upwardly out of the drawer liner 226. Alternately, if, for example, the treating chemistry reservoir 228, 230 is too narrow to allow for the provision of a handle 264, a bevel 266 can be provided in the neighboring treating chemistry reservoir 228, 230 to allow a user finger access to lift out the other treating chemistry reservoir 228, 230. While the treating chemistry reservoirs 228, 230 are illustrated herein as including a handle 264 or bevel 266 that is formed in the treating chemistry reservoir 228, 230, it will be understood that other suitable handle mechanisms for removal of the treating chemistry reservoirs 228, 230 out of the drawer liner 226 can also be used. By way of non-limiting example, a physically protruding handle can be provided on the treating chemistry reservoirs 228, 230 that a user can grip to pull the treating chemistry reservoir 228, 230 upward out of the drawer liner 226, or a flip up handle that is pivotably mounted to the treating chemistry reservoir 228, 230, or the treating chemistry reservoirs 228, 230 can be removed by a push-to-eject mechanism that will release the treating chemistry reservoirs 228, 230 from the drawer liner 226 and push them upward out of the drawer liner 226 so they can be easily gripped by a user for removal.

Figure 10:
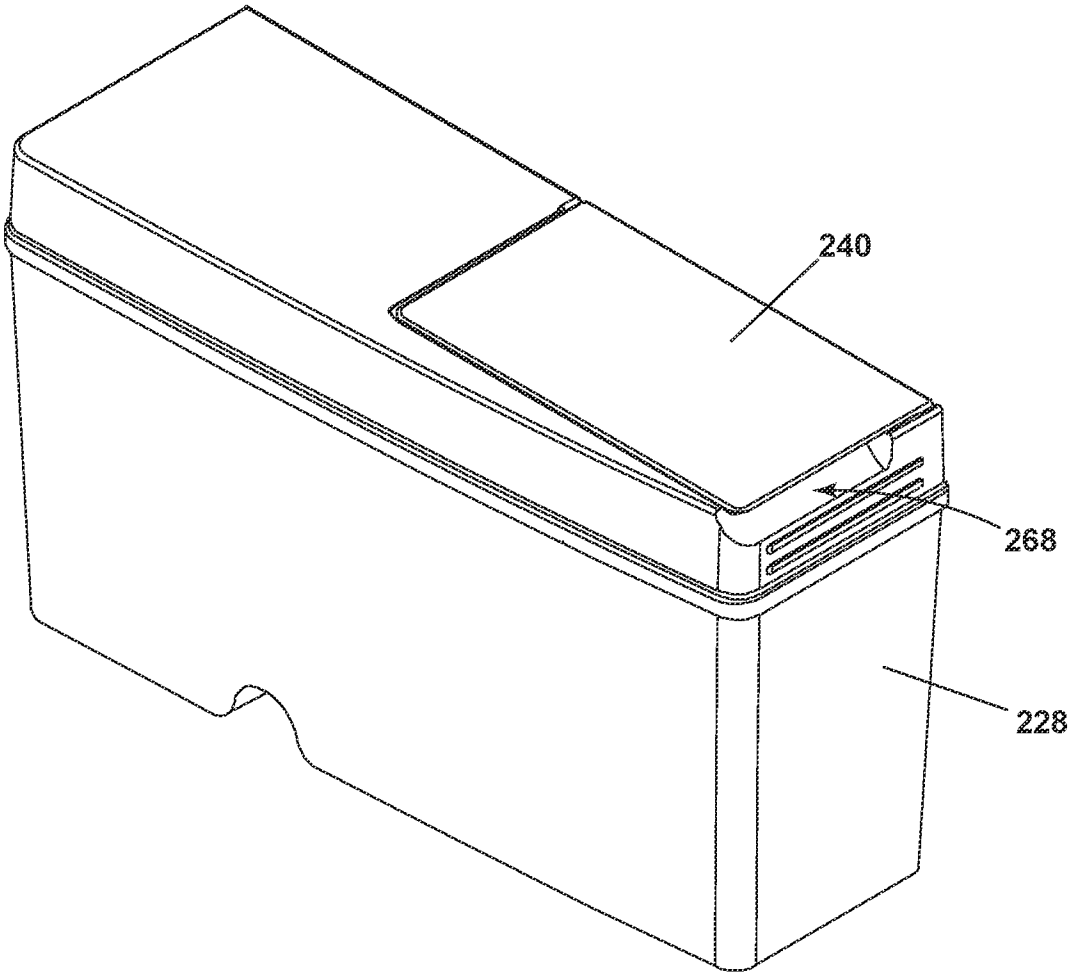
FIG. 10 illustrates an enlarged view of the treating chemistry reservoir of FIG. 9 according to the present disclosure.

FIG. 10 illustrates an enlarged view of the treating chemistry reservoir 228, 230. A lid bevel 268, which can be provided as a scoop or an indentation, can be provided adjacent a peripheral edge of the lid 240. This lid bevel 268 can allow a user the ability to insert a finger into the area of the lid bevel 268, to allow the lid 240 to be easily lifted without pinching or gripping of the lid 240. It is also contemplated that the lid 240 can extend slightly beyond the edge of the treating chemistry reservoir 228, 230 such that a user can simply lift the lid 240 with a finger, without requiring the presence of a lid bevel 268. It will also be understood that the lid 240 can also or alternately be provided with a handle or other gripping protrusion to allow removal by a user.

Figure 11:
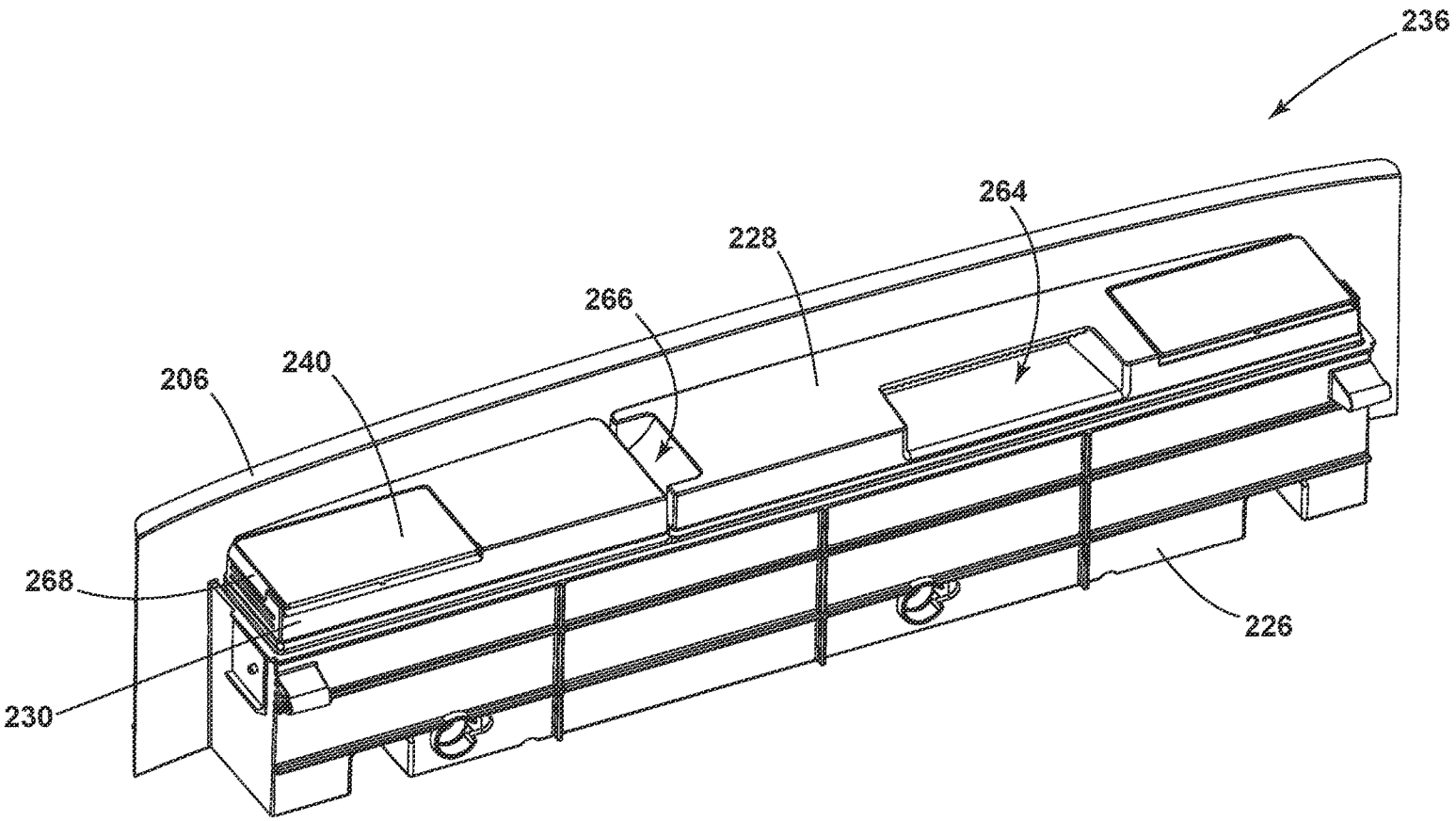
FIG. 11 illustrates a rear perspective view of the bulk dispensing drawer of FIG. 7 according to an aspect of the present disclosure.

FIG. 11 illustrates a rear perspective view of the bulk dispensing drawer 236 in which the handle 264, bevel 266, and lid bevel 268 can be more clearly seen above the height of the drawer liner 226. While the handle 264 and bevel 266 are illustrated herein as structures that are recessed into the treating chemistry reservoir 228, 230, it will be understood that either the handle 264 or the bevel 266, or both, could instead be structures that protrude from the treating chemistry reservoir 228, 230.

Figure 12:
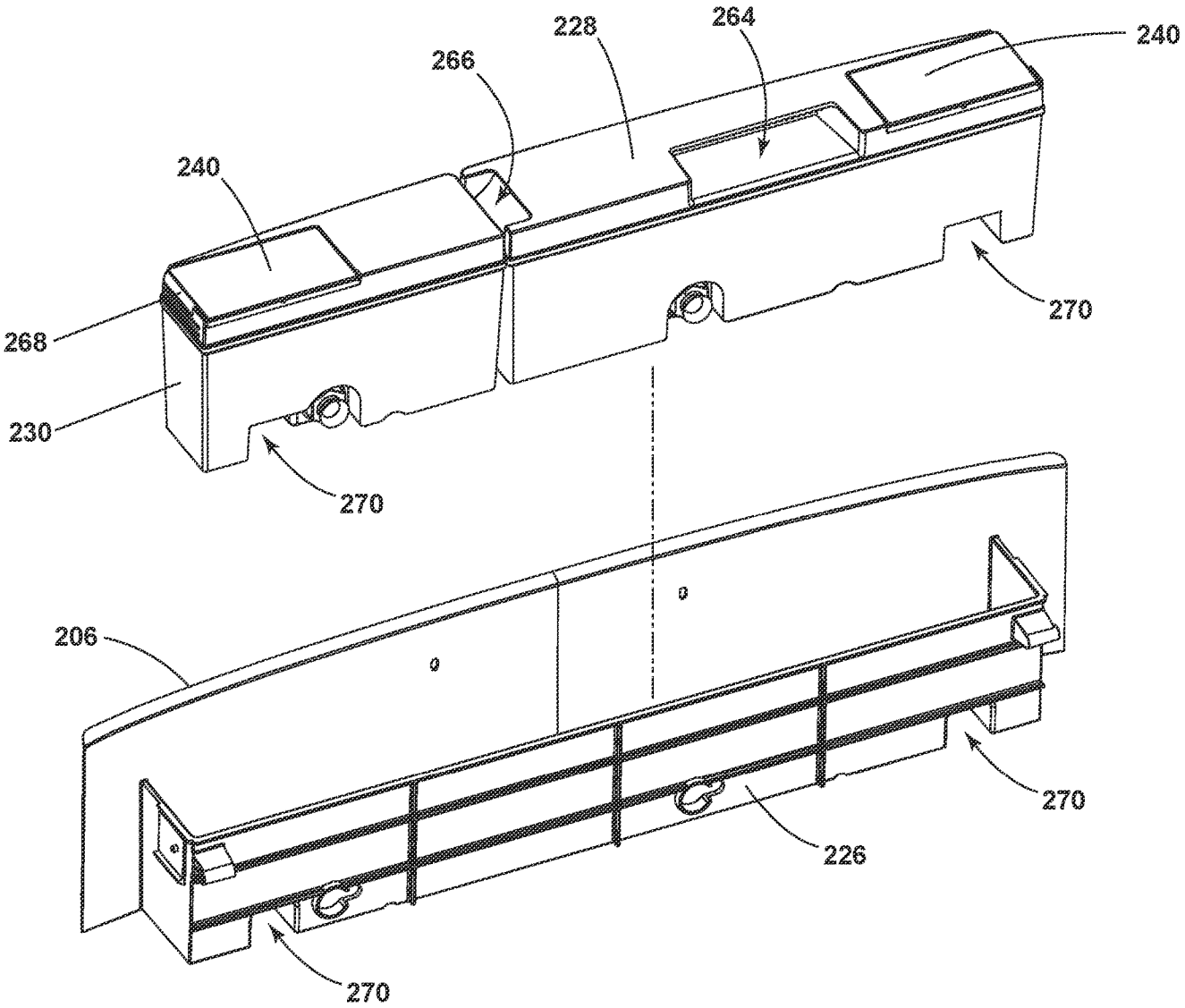
FIG. 12 illustrates an exploded view of the bulk dispensing drawer of FIG. 11 according to the present disclosure.

FIG. 12 illustrates a top rear view of the treating chemistry reservoirs 228, 230 removed from the drawer liner 226 and the front fascia 206. The drawer liner 226 and the treating chemistry reservoirs 228, 230 include at least one alignment recess 270. The alignment recesses 270 assure that the treating chemistry reservoirs 228, 230 can be easily lined up with the drawer liner 226 for ease of insertion therein and to ensure proper alignment of docking features as well.

Figure 13:
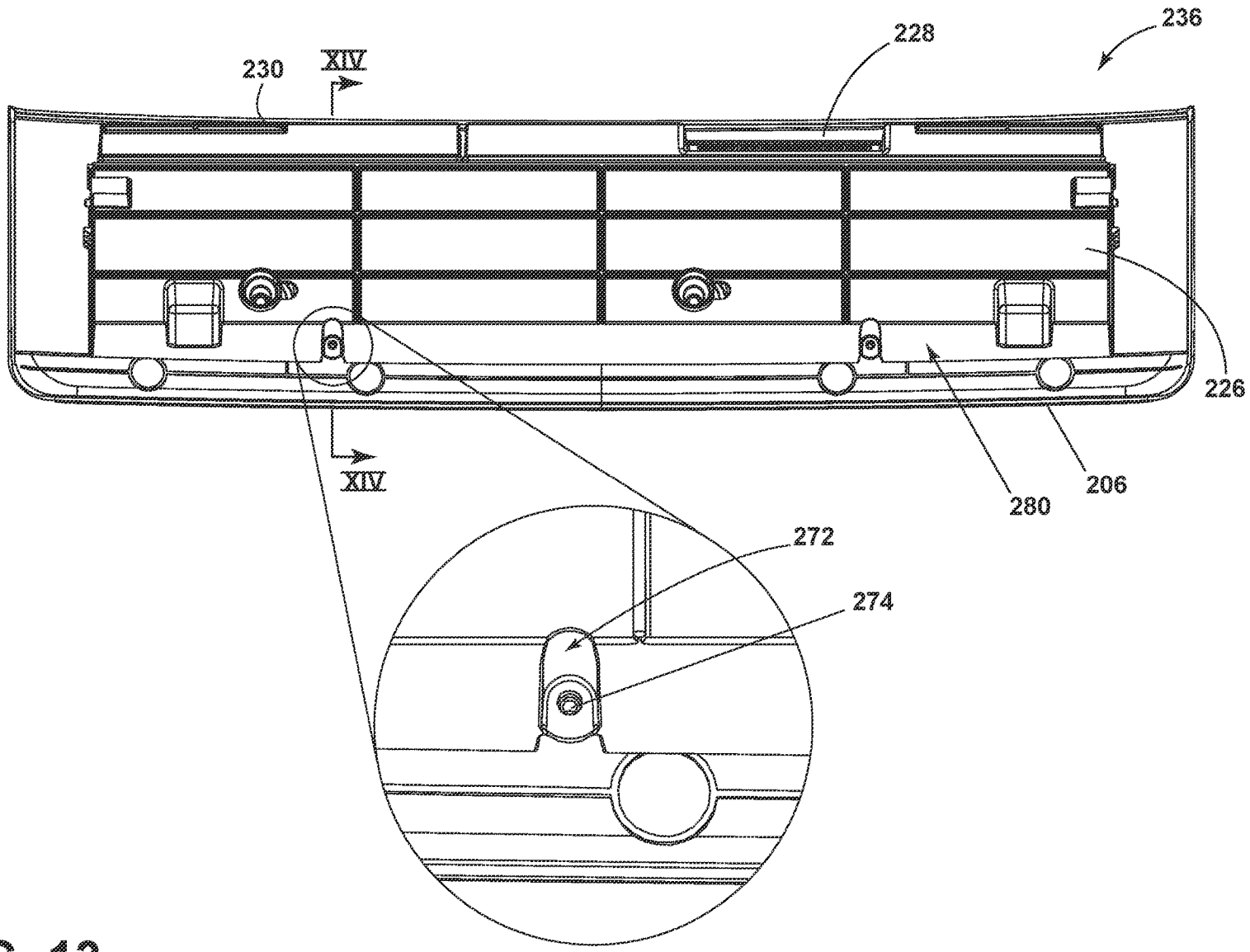
FIG. 13 illustrates a rear perspective view of the bulk dispensing drawer of FIG. 11 according to the present disclosure.

FIG. 13 illustrates a bottom rear view of the bulk dispensing drawer 236 in which features for the connection of the drawer liner 226 to the front fascia 206 can be seen. The drawer liner 226 can include at least one fastener recess 272 in a lower surface 280 of the drawer liner 226. The at least one fastener recess 272 accommodates a fastener 274 that attached the drawer liner 226 to the front fascia 206. Non-limiting examples of such a fastener 274 include a screw, a snap element, a bolt, or a heat stake.

Figure 14:
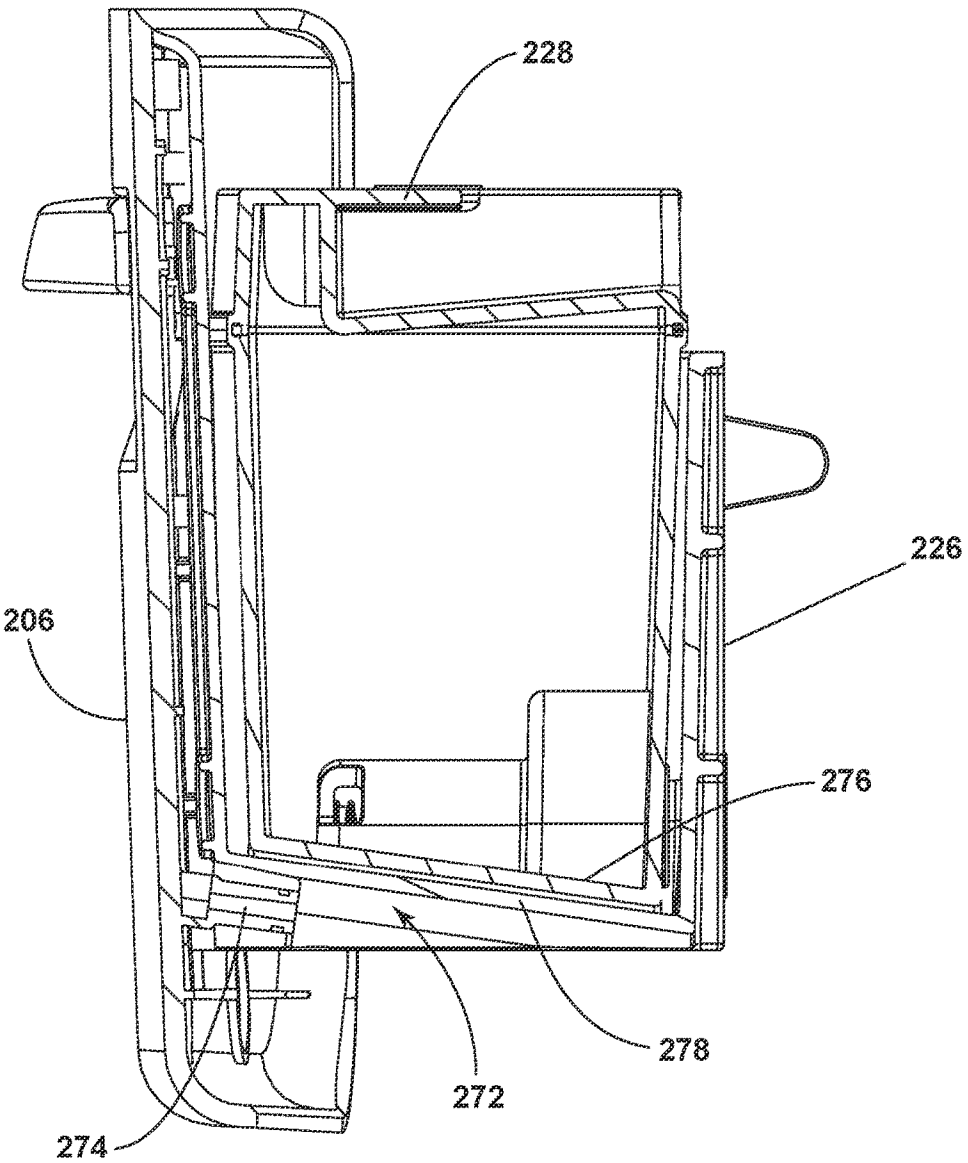
FIG. 14 illustrates a cross-sectional view of the bulk dispensing drawer of FIG. 11 taken along line 14-14 of FIG. 13.

FIG. 14 illustrates a cross-sectional view of the bulk dispensing drawer 236 taking along line 14-14 of FIG. 13. It can be seen that the at least one fastener recess 272 can be angled downwardly from the front fascia 206 to the rear of the drawer liner 226 in order to minimize the impact on the volume of the treating chemistry reservoir 228. By having the height of the fastener recess 272 taper downwardly away from the front fascia 206, the drawer liner 226 effectively has an angled lower surface 278 at the position of the fastener recess 272. Further, for improved fit and alignment between the treating chemistry reservoir 228 and the drawer liner 226, the treating chemistry reservoir 228 can have a corresponding shape, resulting in an angled lower surface 276 within the treating chemistry reservoir 228 at the position of the fastener recess 272.

Figure 15:
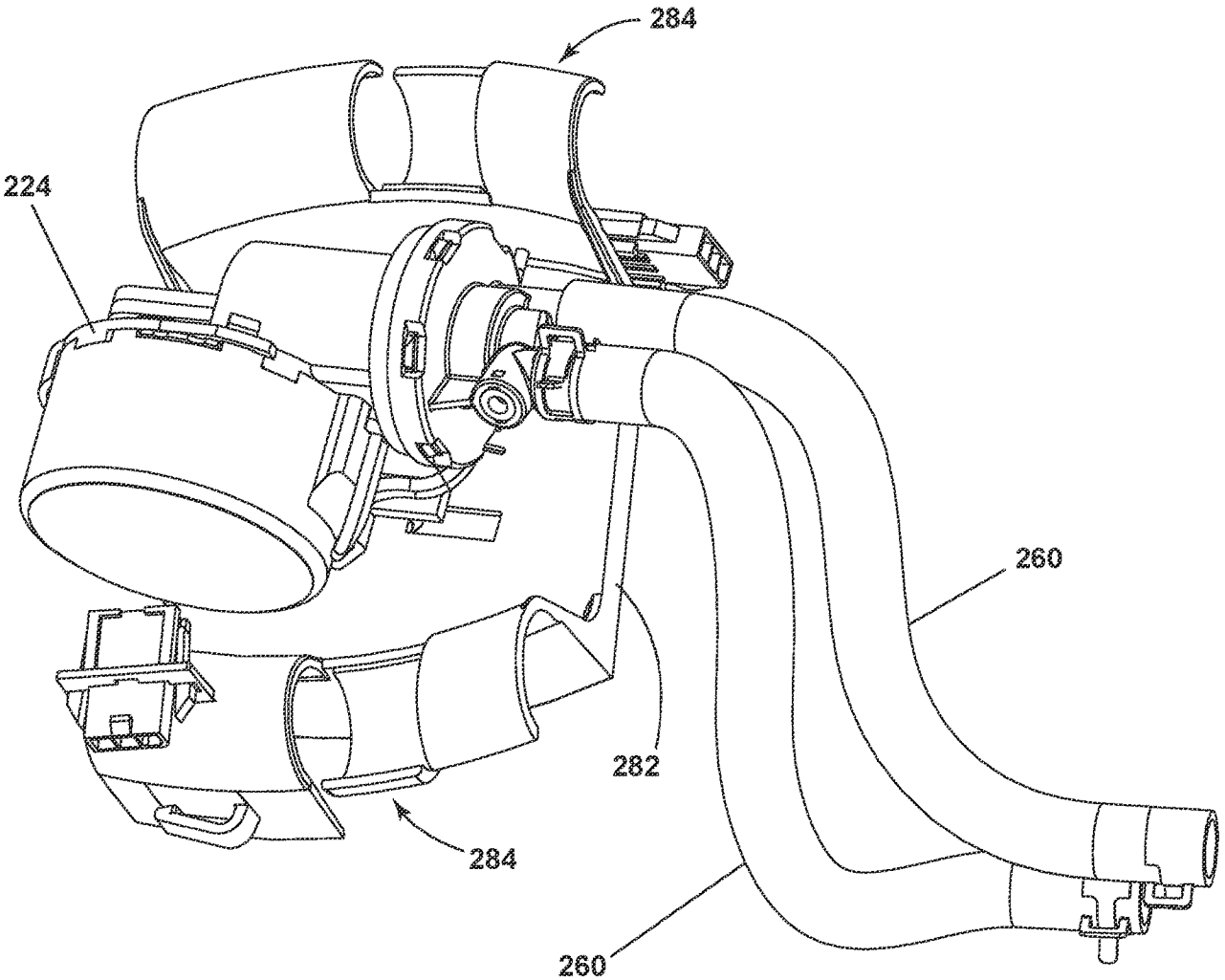
FIG. 15 illustrates a top perspective view of a carrier mount for use with the bulk dispensing assembly of FIG. 4 according to an aspect of the present disclosure.

FIG. 15 illustrates an alternate mount for the metering pump 224 according to an aspect of the present disclosure.

Rather than mounting the metering pump 224 to the rear surface 222 of the drawer backer 218 as previously discussed, in another aspect, the metering pump 224 can be coupled to a carrier plate 282. In some cases it may be desired to decouple the metering pump 224 from the movements and vibration of the laundry treating appliance 10. When the metering pump 224 is mounted to the drawer backer 218, it is subject to movement and vibration from both the cabinet 12 and the bulk dispensing assembly 200, such as vibration during operation of the laundry treating appliance 10, movement from the opening and closing of the bulk dispensing drawer 236, or jostling during transport and installation of the laundry treating appliance 10. The carrier plate 282 instead couples the metering pump 224 to hoses present within the cabinet 12, allowing for a flexible attachment that is less likely to result in wear on the metering pump 224. By way of non-limiting example, the carrier plate 282 can physically suspend the metering pump 224 from the hose or hoses. Non-limiting examples of such a hose that the carrier plate 282 can attach to include a drain hose, a recirculation hose, a sump hose, a bulk treating chemistry dispenser hose, a water supply hose, or a hot or cold water inlet hose. The metering pump 224 can be suspended between two hoses, which can be spaced water supply hoses.

The carrier plate 282 includes hose attachment members 284 that can fasten around hoses within the cabinet 12 to provide a flexible mount for the metering pump 224 that can have shock absorption functions. The hose attachment members 284 can fasten loosely around the hoses in order to allow some movement of the hoses through the hose attachment members 284 without translating that movement to the metering pump 224. The conduits 260 that receive liquid from the treating chemistry reservoirs 228, 230 fluidly couple to the metering pump 224, which can be in turn fluidly coupled with the liquid supply assembly of the laundry treating appliance 10.

Figure 16:
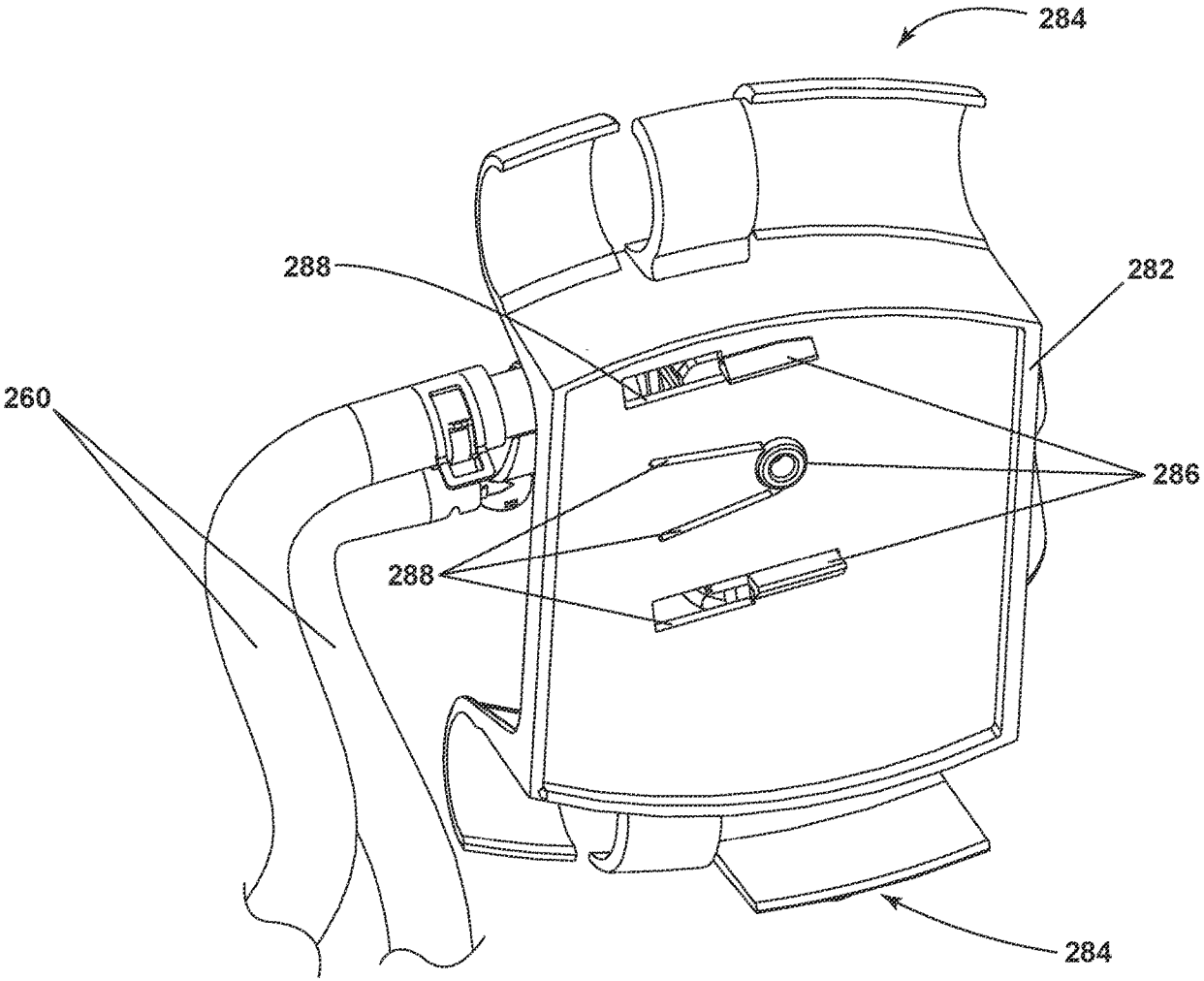
FIG. 16 illustrates a bottom perspective view of the carrier mount of FIG. 15 according to the present disclosure.

FIG. 16 illustrates a bottom view of the carrier plate 282. The carrier plate 282 can include receiving slots 288 that can accommodate attachment hooks 286 of the metering pump 224. The attachment hooks 286 and the receiving slots 288 are illustrated herein as including a bayonet-type slide-lock mechanism and a snap-in attachment mechanism. However, it will be understood that any suitable method of coupling the metering pump 224 to the carrier plate 282 can be used, non-limiting examples of which include screws, snap-in features, bolts, screw-in features, or other methods of mechanical attachment.

Figure 17:
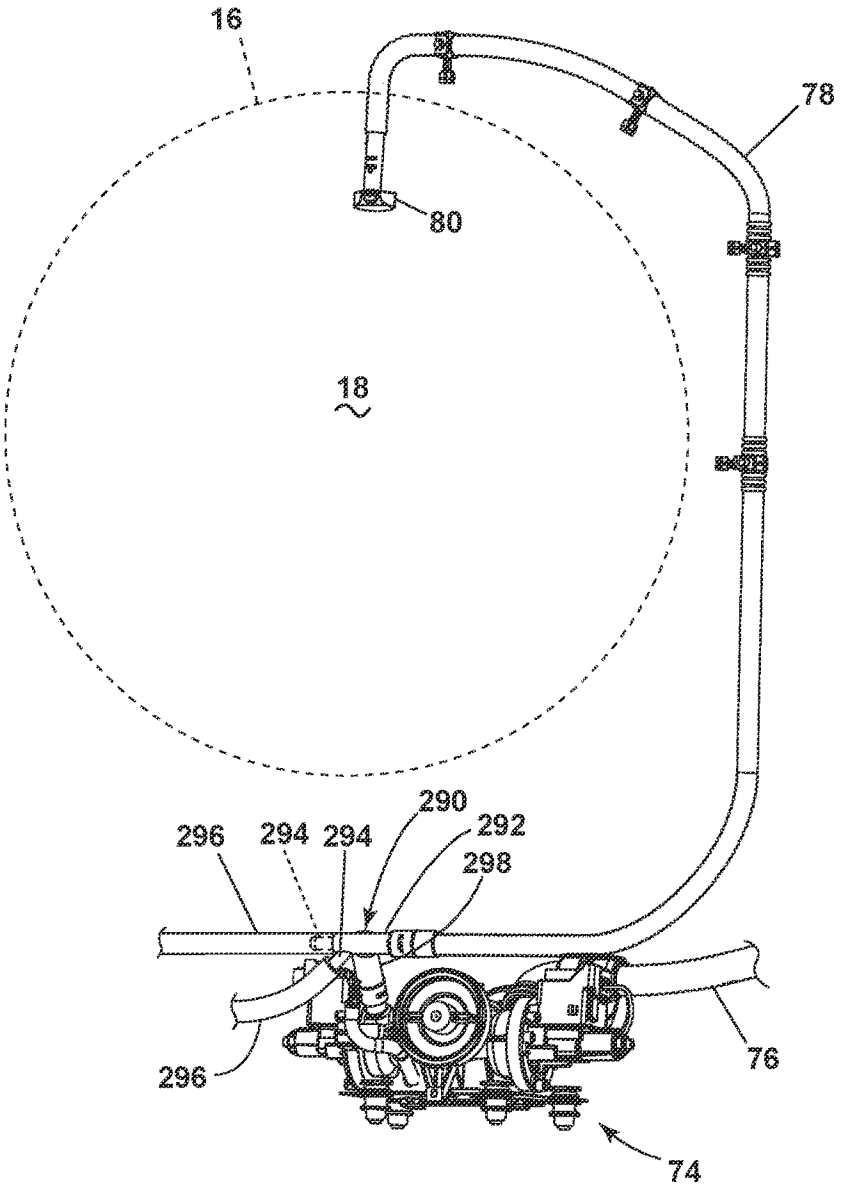
FIG. 17 illustrates a liquid supply assembly for use with the bulk dispensing assembly of FIG. 4 according to an aspect of the present disclosure.

FIG. 17 illustrates a liquid supply assembly for providing treating chemistries from the bulk dispensing assembly 200 into the treating chamber 18. Providing treating chemistries directly into the treating chamber 18 without mixing them with the liquid supply of the laundry treating appliance 10 first can result in hot spots of undesirably high concentration of treating chemistries, rather than an even distribution throughout the treating chamber 18. The liquid supply assembly set forth here results in even mixing of the treating chemistries with a recirculation flow in the laundry treating appliance 10, resulting in ideal distribution of the treating chemistries within the treating chamber 18. Conduits 296, which can be dispensing hoses, can fluidly couple the metering pumps 224 with treating chemistry inlets 294 to a dosing coupler 290. The dosing coupler 290 further includes a recirculation inlet 298 that is fluidly coupled with a recirculation pump 74, the recirculation pump 74 having an inlet and an outlet. Liquid supplied through the treating chemistry inlets 294 and the recirculation inlet 298 is then provided together to exit the dosing coupler 290 via an outlet 292, which is fluidly coupled with a recirculation conduit 78. The treating chemistry inlets 294 can be provided at an angle relative to the recirculation inlet 298 and/or to the outlet 292 or the liquid supplied from the recirculation pump 74. The angle can be an acute angle, which can be defined by the dosing coupler 290. In an exemplary aspect, the dosing coupler 290 and the treating chemistry inlets 294 can be formed from a hard plastic, while the recirculation inlet 298 is formed of a rubber or other thermoplastic elastomer that is joined with the hard plastic to form the dosing coupler 290 as a single part.

The treating chemistries are mixed with the recirculation liquid both within the dosing coupler 290 and within the recirculation conduit 78, both of which can be thought of as a mixing chamber, due to the force of the liquid exiting the recirculation pump 74, which results in shearing of the treating chemistries with the recirculation liquid and within the recirculation circuit. From the recirculation conduit 78, the treating chemistry and recirculation liquid mixture is provided to a recirculation inlet 80, which allows the treating chemistry and recirculation liquid mixture to enter the treating chamber 18. In an exemplary aspect, and by way of non-limiting example, the recirculation inlet 80 can be a spray nozzle and can enter the drum 16 and the treating chamber 18 at an upper portion of the drum 16. In this way, treating chemistries from the bulk dispensing assembly 200 are supplied directly into the recirculation liquid where they can be properly mixed within the recirculation conduit 78 before being provided to the treating chamber 18.

Figure 18:
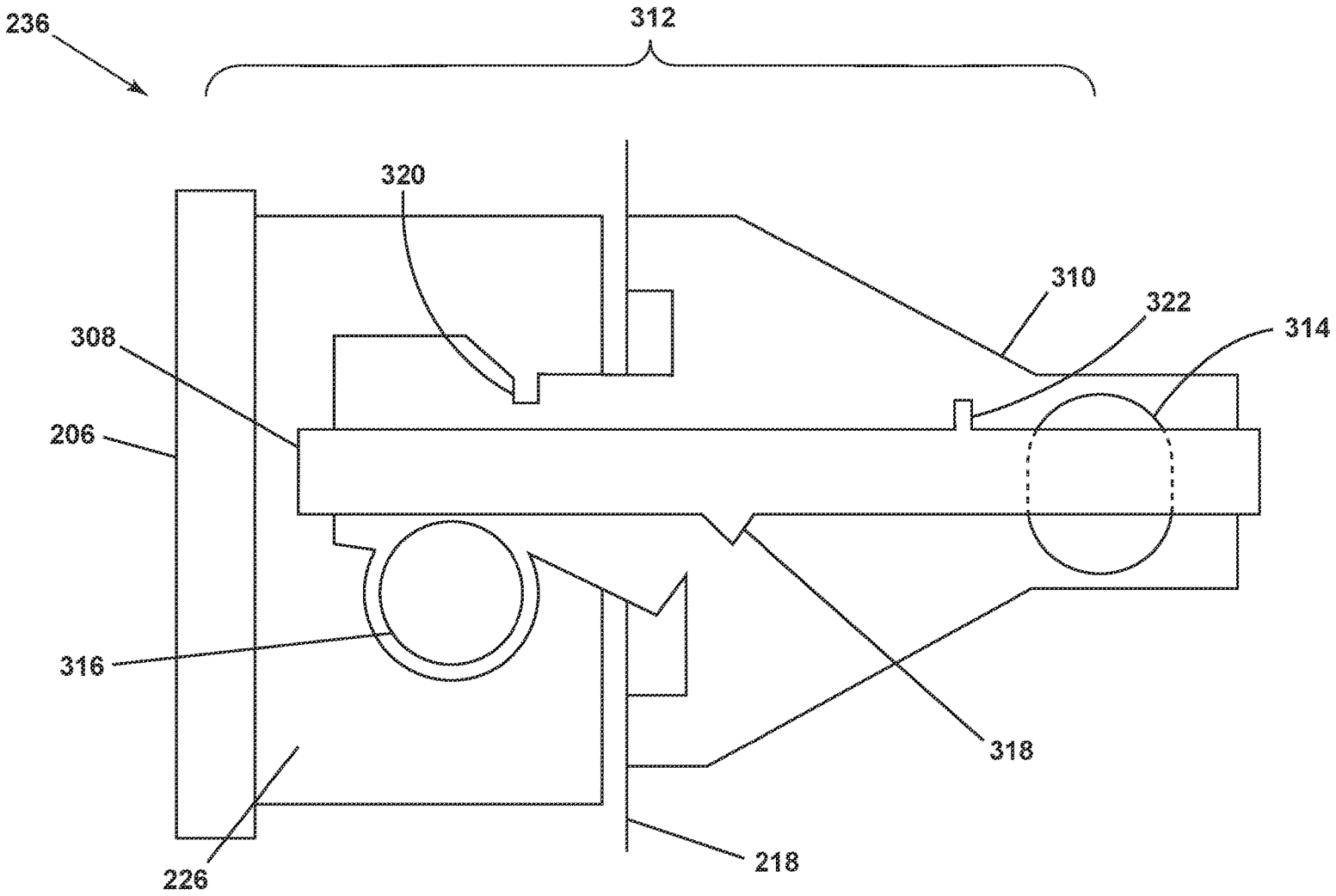
FIG. 18 illustrates a rail assembly for use with the bulk dispensing assembly of FIG. 4 according to an aspect of the present disclosure with the bulk dispensing drawer in a closed position.

FIG. 18 illustrates another aspect of a rail assembly 312 that can have reduced friction between the components to achieve an improved smooth guide of the bulk dispensing drawer 236. The bulk dispensing drawer 236 is in a completely closed position. A drawer rail 308 having a drawer rail roller 314 is received within a rail supporter 310. The drawer rail roller 314 allows the drawer rail 308 to roll within the rail supporter 310. The rail supporter 310 further includes a lower roller 316 that is positioned beneath the drawer rail 308 to further improve smoothness of movement of the bulk dispensing drawer 236 and to help support the weight of the bulk dispensing drawer 236. In an exemplary aspect, both the drawer rail 308 and the rail supporter 310 are formed from polyamide, while both the drawer rail roller 314 and the lower roller 316 are formed from polyoxymethylene with an outer layer formed from a thermoplastic elastomer. The use of these materials results in reduced friction and allows for an improved gliding withdrawal of the bulk dispensing drawer 236 without the need for the use of grease or lubricant.

Figure 19:
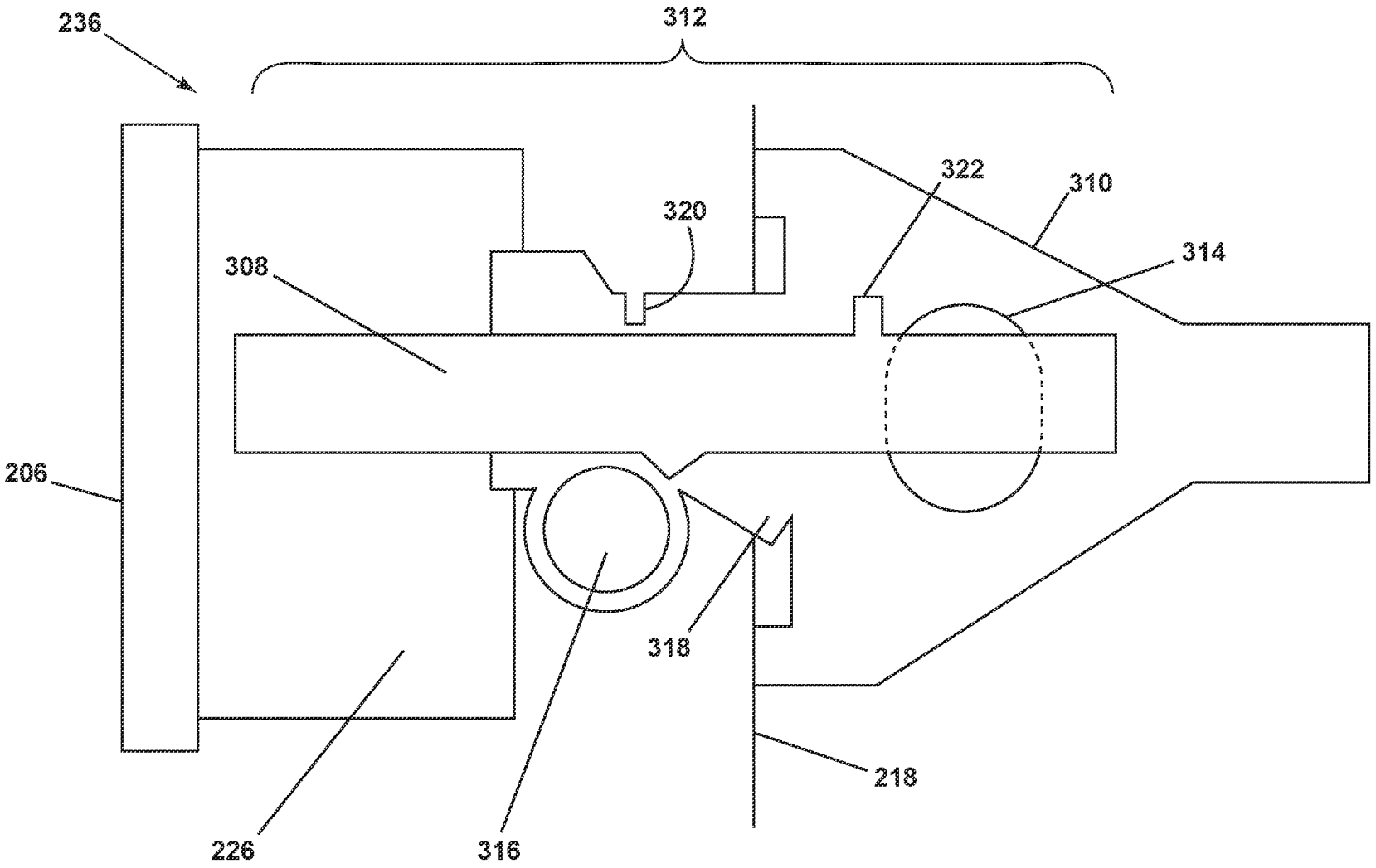
FIG. 19 illustrates the rail assembly of FIG. 18 with the bulk dispensing drawer in a partially opened position.

FIG. 19 illustrates the rail assembly 312 in a partially withdrawn position. The bulk dispensing drawer 236 has been withdrawn until a rail protrusion 318 has come into contact with the lower roller 316, increasing resistance to further withdrawal of the bulk dispensing drawer 236, but not preventing further withdrawal.

Figure 20:
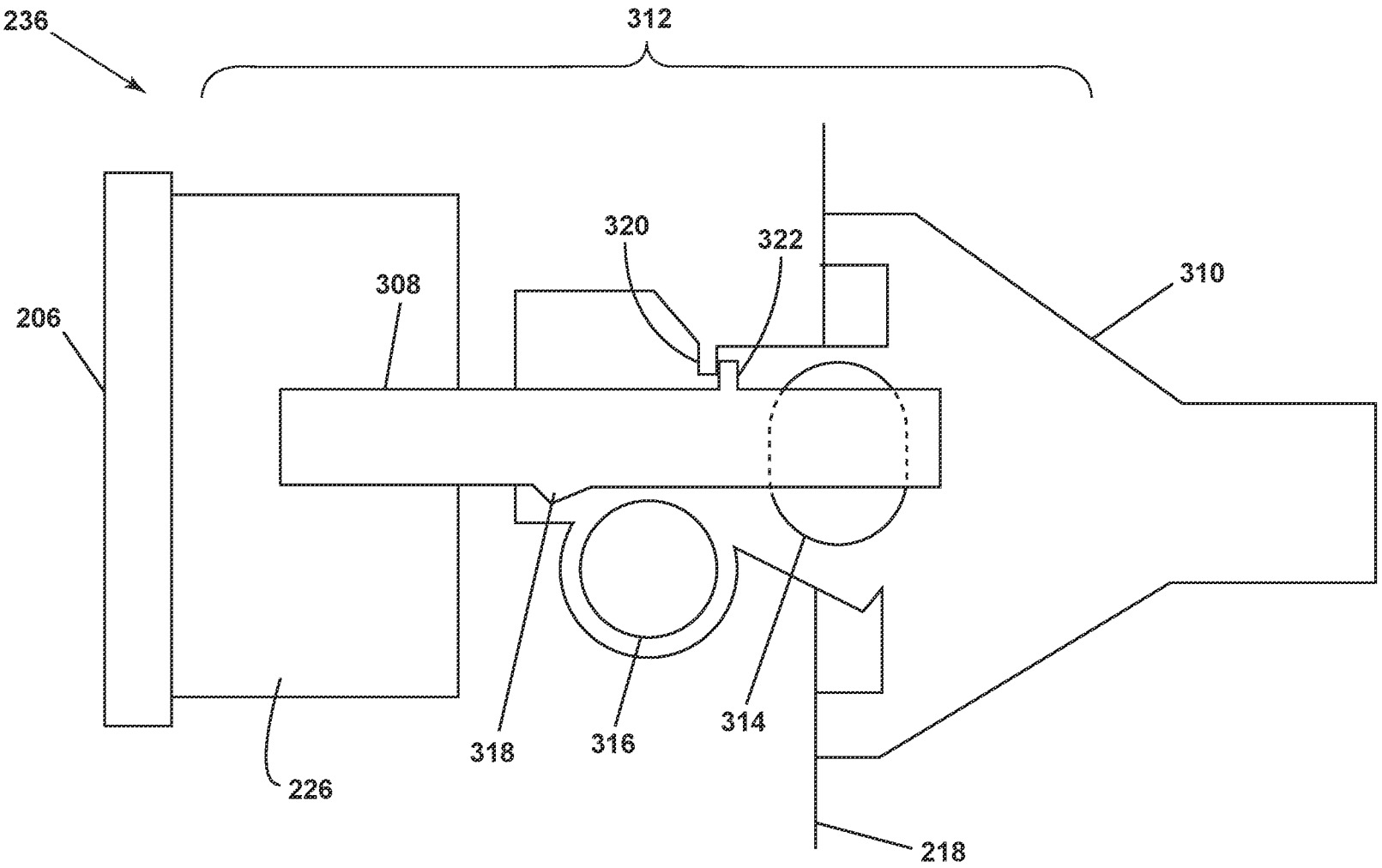
FIG. 20 illustrates the rail assembly of FIG. 18 with the bulk dispensing drawer in a completely opened position.

FIG. 20 illustrates the rail assembly 312 in a completely withdrawn position. While the rail protrusion 318 has moved past the lower roller 316, in the completely withdrawn position, a rail stopper 322 has come into contact with a rail supporter stopper 320, preventing further forward withdrawal of the bulk dispensing drawer 236.

Figure 21:
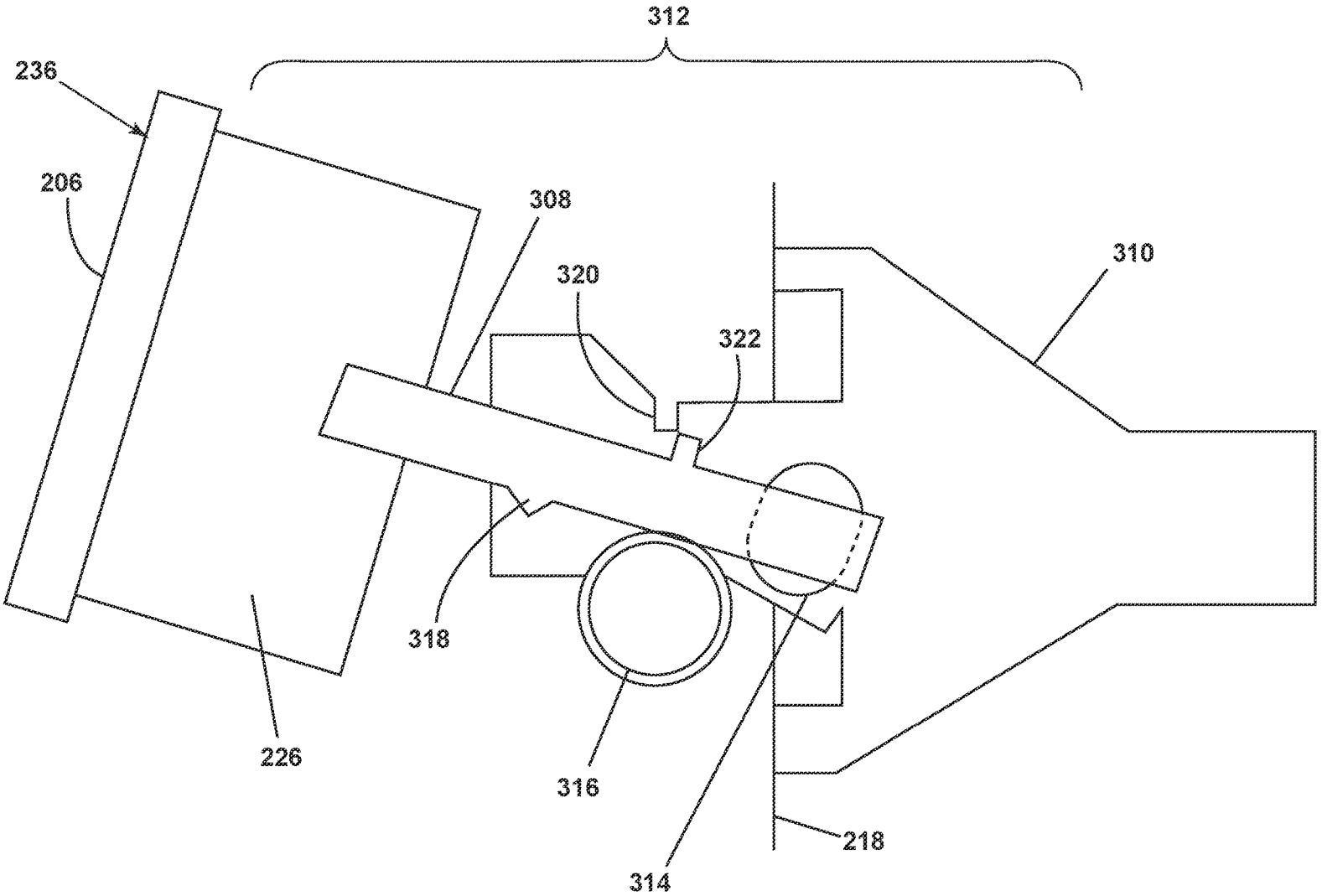
FIG. 21 illustrates the rail assembly of FIG. 18 with the bulk dispensing drawer in a removal position.

FIG. 21 illustrates the rail assembly 312 in a removal position. Once the rail stopper 322 contacts the rail supporter stopper 320, as shown in FIG. 20, the only way the bulk dispensing drawer 236 can be removed from the cabinet 12 further is by tilting the front fascia 206 upwardly, which angles the bulk dispensing drawer 236 in order to allow disengaging of the rail stopper 322 from the rail supporter stopper 320, such that the rail stopper 322 can pass underneath the rail supporter stopper 320, allowing for complete removal of the bulk dispensing drawer 236 from the laundry treating appliance 10.

Figure 22:
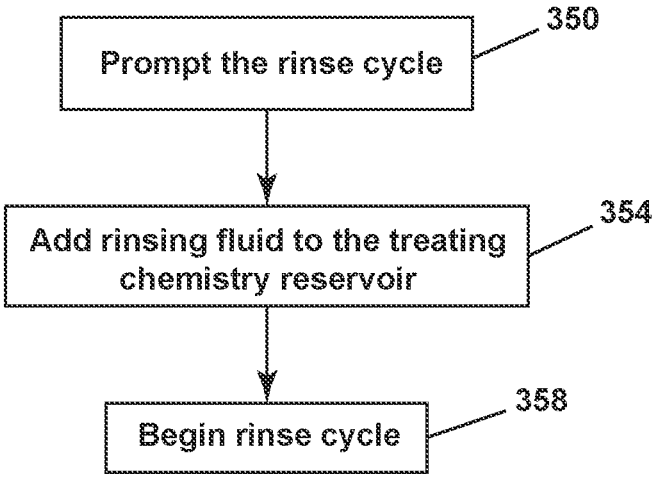
FIG. 22 illustrates a flow chart for a process for initiating a rinse cycle for at least one of the treating chemistry reservoirs of FIG. 9.

FIG. 22 illustrates a flow chart for a process for rinsing and/or cleaning at least one of the treating chemistry reservoirs 228, 230. When treating chemistries have been stored within the treating chemistry reservoirs 228, 230, it is possible for residues to form within the treating chemistry reservoirs 228, 230. This can occur as a result of long-term storage of a single treating chemistry, or changing the type of treating chemistry contained within a single treating chemistry reservoir 228, 230 can cause the formation of a residue, non-limiting examples of which include a paste which can be white in color, a film, or a crusted substance. Such a residue can form either within the treating chemistry reservoir 228, 230, within the liquid passage 256 of the docking plunger 250, within the conduit 260 coupling the docking plunger 250 to the metering pump 224, within the conduits 296 that couple the metering pumps 224 to the dosing coupler 290, or in any other location that is exposed to the treating chemistry and any combination of these locations.

At step 350, the rinse cycle is prompted. For example, the controller 96 can display a prompt on the user interface 98 to indicate to the user that a rinse cycle for the bulk dispensing assembly 200 should be initiated. The controller 96 can be programmed to display the prompt, by way of non-limiting example, after a predetermined number of cycles of operation of the laundry treating appliance 10, after a predetermined number of cycles or amount of time since a treating chemistry has last been added to the treating chemistry reservoir 228, 230, when the treating chemistry reservoir 228, 230 is empty or nearly empty, or when a user inputs information to the user interface 98 indicating that the treating chemistry contained within a treating chemistry reservoir 228, 230 is going to be changed. It is also contemplated that a user can initiate the rinse cycle at any point in time by selecting the bulk dispensing assembly 200 rinse cycle option via the user interface 98. Further, a user instruction manual for the laundry treating appliance 10 can instruct the user to the frequency with which the rinse cycle should be initiated, or after what type of events the rinse cycle should be initiated, and the user can then select the rinse cycle accordingly via the user interface 98.

When the rinse cycle has been prompted at step 350, rinsing fluid can be added to the treating chemistry reservoir 228, 230 at step 354. It will be understood that the rinse cycle can be prompted and/or selected to rinse both of the treating chemistry reservoirs 228, 230 during the rinse cycle, or to select that only a single one of the treating chemistry reservoirs 228, 230 will be rinsed. When it is determined by the laundry treating appliance 10 or by the user which of the treating chemistry reservoirs 228, 230 will be rinsed, the user can fill the selected treating chemistry reservoir(s) 228, 230 with a rinsing fluid. The rinsing fluid can be water or any suitable cleaning solution. In an exemplary aspect, the rinsing fluid can be hot water, though it will be understood that any temperature of water or cleaning solution can be used. Further, the treating chemistry reservoir 228, 230 can be filled to a predetermined fill level, which can be, by way of non-limiting example, half full, three quarters full, completely full, or any suitable fill level for sufficient rinsing of the treating chemistry reservoir 228, 230. While the treating chemistry reservoir 228, 230 is described herein as being filled with the rinsing fluid by a user, it will be understood that the treating chemistry reservoir 228, 230 can also be filled with rinsing fluid by plumbing provided within the laundry treating appliance 10. By way of non-limiting example, an inlet can be provided to the treating chemistry reservoir 228, 230 that can allow rinsing fluid to be provided to the treating chemistry reservoir 228, 230 from the household water supply 40, from the recirculation flow within the laundry treating appliance 10, or from a rinsing fluid reservoir that can be provided within the laundry treating appliance 10.

After rinsing fluid has been added to the treating chemistry reservoir 228, 230 at step 354, the rinse cycle can be initiated and begin at step 358 by user input through the user interface 98, or by a determination by the laundry treating appliance 10 that the appropriate treating chemistry reservoirs 228, 230 have been filled with the appropriate amount of rinsing fluid.

Figure 23:
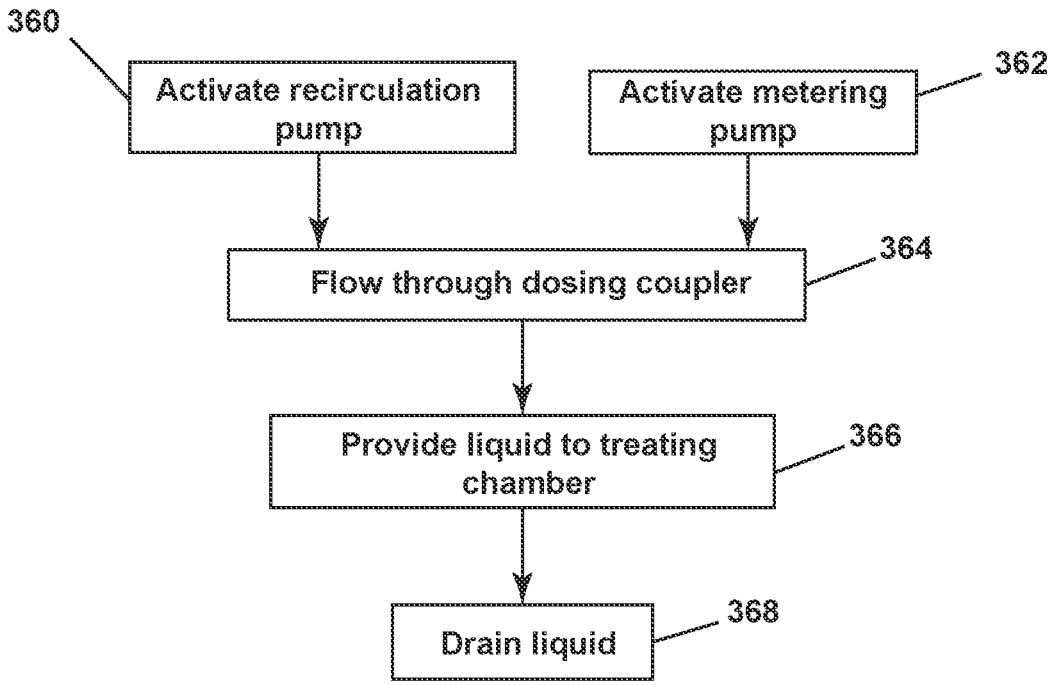
FIG. 23 illustrates a flow chart for the rinse cycle of FIG. 22.

FIG. 23 illustrates a flow chart for the rinse cycle of FIG. 22. When the rinse cycle has been initiated at step 354, the recirculation pump 74 can be activated at step 360 and the metering pump or pumps 224 can be activated at step 362. While steps 360 and 362 are illustrated herein as occurring simultaneously, it will be understood that the recirculation pump 74 and the metering pump 224 can also be activated sequentially. The household water supply 40 can also be activated if additional water is desired to further rinse the recirculation conduit 78, but it will be understood that the household water supply 40 need not be activated in order for the bulk dispensing assembly 200 rinse cycle to be completed. When the metering pump 224 is activated, the rinsing fluid is drawn from the treating chemistry reservoir 228, 230 through the conduit 260, and through the metering pump 224 into the conduit 296. When the recirculation pump 74 is activated, the rinsing fluid can be subsequently drawn from the metering pump 224 through the conduit 296 and into the dosing coupler 290 at step 364. The rinsing fluid in the dosing coupler 290 can mix with any other liquid that may be present in the recirculation conduit 78 as the rinsing fluid is moved into the recirculation conduit 78 by the recirculation pump 74. The rinsing fluid is pumped by the recirculation pump 74 through the recirculation inlet 80 and into the treating chamber 18 at step 366. Rinsing fluid in the treating chamber 18 can be pumped out of the laundry treating appliance 10 via a drain conduit 76 at step 368.

Referring back to FIG. 2, and in further detail, the laundry holding assembly comprises a tub 14 dynamically suspended within the structural support assembly of the cabinet 12 by a suitable suspension assembly 28, the drum 16 provided within the tub 14. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle with the receptacle defining the laundry treating chamber for receiving the load to be treated.

The door 24 can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The laundry treating appliance 10 can further include a liquid supply assembly for supplying water to the laundry treating appliance 10 for use in treating laundry during a cycle of operation. The liquid supply assembly can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The laundry treating appliance 10 can also be provided with a dispensing assembly, separate from the bulk dispensing assembly 200, for dispensing treating chemistry to the treating chamber 18 for use in treating the laundry according to a cycle of operation. The dispensing assembly can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply assembly through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing assembly during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to the pump 74. The pump 74 can direct liquid to the drain conduit 76, which can drain the liquid from the laundry treating appliance 10, or to the recirculation conduit 78, which can terminate at the recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 2, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The laundry treating appliance 10 also includes a control assembly for controlling the operation of the laundry treating appliance 10 to implement one or more cycles of operation. The control assembly can include the controller 96 located within the cabinet 12 and the user interface 98 that is operably coupled with the controller 96. The user interface 98 can include one or more knobs, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the laundry treating appliance 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 3:
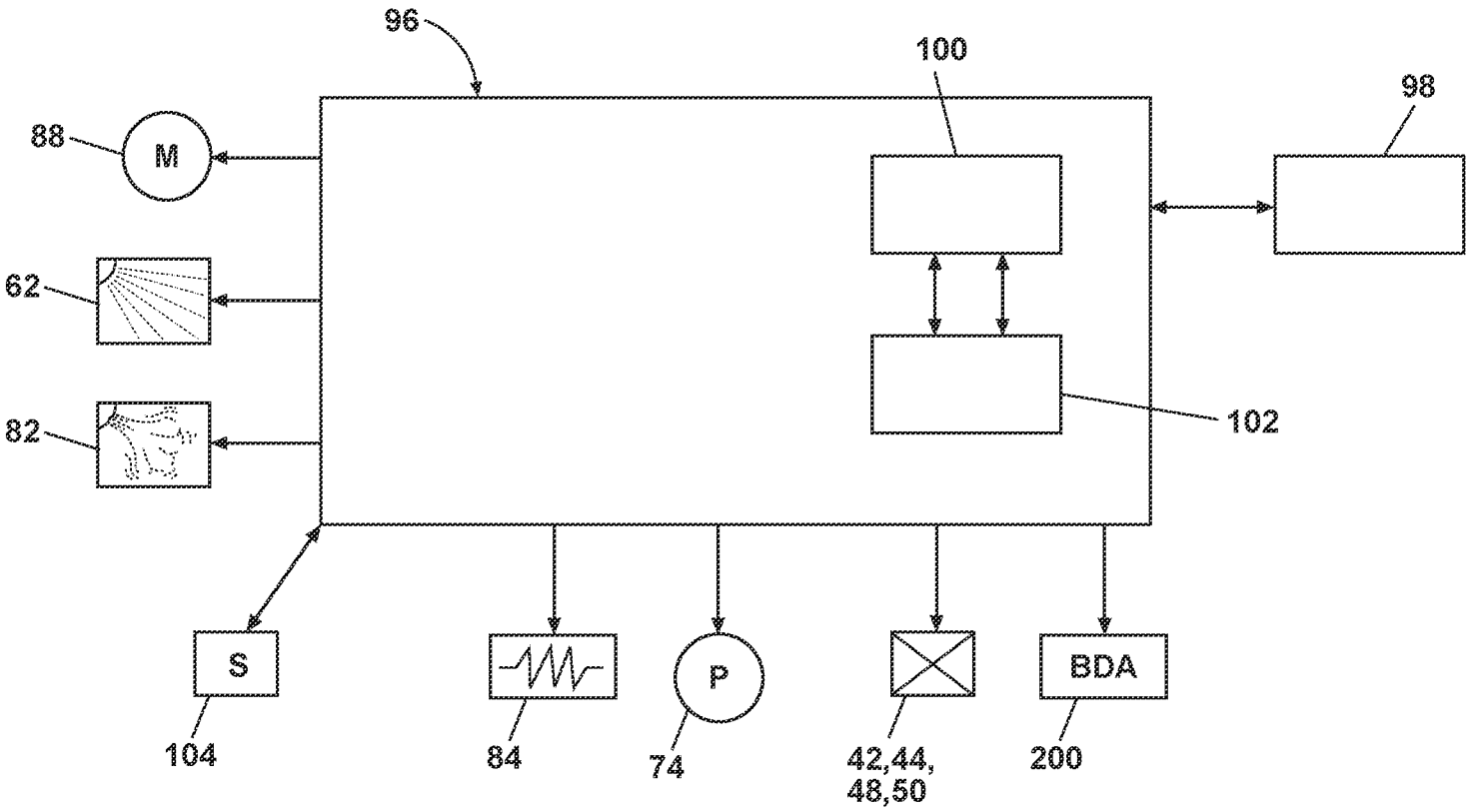
FIG. 3 illustrates a schematic of a control assembly of the laundry treating appliance of FIG. 2 according to an aspect of the present disclosure.

As illustrated in FIG. 3, the controller 96 can be provided with a memory 100 and a central processing unit (CPU) 102. The memory 100 can be used for storing the control software that is executed by the CPU 102 in completing a cycle of operation using the laundry treating appliance 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the laundry treating appliance 10 that can be communicably coupled with the controller 96. The database or table can be used to store the various operating parameters for the one or more cycles of operation, including factory default values for the operating parameters and any adjustments to them by the control assembly or by user input.

The controller 96 can be operably coupled with one or more components of the laundry treating appliance 10 for communicating with and controlling the operation of the component to complete a cycle of operation. For example, the controller 96 can be operably coupled with the motor 88, the pump 74, the treating chemistry dispenser 62, the steam generator 82, the sump heater 84, and the bulk dispensing assembly 200 to control the operation of these and other components to implement one or more of the cycles of operation.

The controller 96 can also be coupled with one or more sensors 104 provided in one or more of the assemblies of the laundry treating appliance 10 to receive input from the sensors, which are known in the art and not shown for simplicity. Non-limiting examples of sensors 104 that can be communicably coupled with the controller 96 include: a treating chamber temperature sensor, a moisture sensor, a weight sensor, a chemical sensor, a position sensor and a motor torque sensor, which can be used to determine a variety of assembly and laundry characteristics, such as laundry load inertia or mass.

The aspects described herein set forth a bulk dispensing assembly for a laundry treating appliance that allows for improved user experience and flexibility. The use of a bulk dispensing drawer can allow a user easy access to treating chemistry reservoirs, which can either be filled in place within the bulk dispensing drawer, or can be removed to be filled at a more convenient location for the user. In addition, both the treating chemistry reservoirs and the drawer liner for the bulk dispensing drawer contain features that allow easy insertion, easy removability, and easy alignment, while having minimal impact on the volume of the treating chemistry reservoirs. Methods are also provided for rinsing the treating chemistry reservoirs, which can prevent the presence of residues within the treating chemistry reservoirs.

Rail assemblies for the bulk dispensing assembly provide a variety of solutions for improving smoothness of the withdrawal of the bulk dispensing drawers, from optimizing the configuration and materials used for the rail system, to providing additional features like the complete removability of the bulk dispensing drawer to allow access to the cabinet for maintenance, service, or cleaning of filters or other parts. In addition, improved pump mounting assemblies for increased durability and reduced wear are set forth, as well as improved structures for ensuring the appropriate mixing of treating chemistries before they are provided to the treating chamber.

To the extent not already described, the different features and structures of the various aspects can be used in combination with each other as desired, or can be used separately. That one feature may not be illustrated in all of the aspects is not meant to be construed that it cannot be, but is done for brevity of description. Thus, the various features of the different aspects can be mixed and matched as desired to form new aspects, whether or not the new aspects are expressly described.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the aspects disclosed herein are not to be considered as limiting, unless expressly stated otherwise.

What is claimed is:

1. A method of rinsing or cleaning a bulk treating chemistry dispenser for a laundry treating appliance, the method comprising:

monitoring an operation of the laundry treating appliance;

determining by a controller that a rinse cycle or a cleaning cycle for the bulk treating chemistry dispenser is due; and prompting a user to add rinsing liquid to at least one treating chemistry reservoir contained within the bulk treating chemistry dispenser.

2. The method of claim 1 wherein the monitoring comprises monitoring a number of cycles of operation of the laundry treating appliance.

3. The method of claim 1 wherein the monitoring comprises monitoring an amount of time since a treating chemistry has last been added to the at least one treating chemistry reservoir.

4. The method of claim 1 wherein the monitoring comprises monitoring a state of the at least one treating chemistry reservoir.

5. The method of claim 4 wherein the state of the at least one treating chemistry reservoir comprises a level of treating chemistry therein or emptiness thereof.

6. The method of claim 4 wherein the state of the at least one treating chemistry reservoir includes information indicating that the treating chemistry contained within the at least one treating chemistry reservoir is going to be changed.

7. The method of claim 6 wherein the monitoring comprises receiving information from a user interface of the laundry treating appliance.

8. The method of claim 1 wherein determining that the rinse cycle or cleaning cycle is due includes a user initiating a rinse cycle or cleaning cycle via a user interface of the laundry treating appliance.

9. The method of claim 1 wherein the bulk treating chemistry dispenser comprises multiple treating chemistry reservoirs.

10. The method of claim 9 wherein the determining by the controller comprises determining that the rinse cycle or the cleaning cycle is due for only one of the multiple treating chemistry reservoirs and the prompting comprises prompting the user to add rinsing liquid to the one of the multiple treating chemistry reservoirs.

11. The method of claim 1, further comprising initiating the rinse cycle or the cleaning cycle based on a user input and/or a determination by the laundry treating appliance rinsing liquid has been added to the at least one treating chemistry reservoir.

12. The method of claim 11, further comprising monitoring a state of the treating chemistry reservoir.

13. The method of claim 12 wherein the controller determines the at least one treating chemistry reservoir has been filled with the appropriate amount of rinsing fluid based on the rinsing and initiating the rinse cycle or the cleaning cycle based thereon.

14. The method of claim 1 wherein the laundry treating appliance further comprises a recirculation circuit including a recirculation pump and at least one metering pump fluidly coupled to the at least one treating chemistry reservoir.

15. The method of claim 14 wherein the recirculation pump and the at least one metering pump are operated sequentially during the rinse cycle or the cleaning cycle.

16. The method of claim 14, further comprising draining the rinsing liquid.

17. The method of claim 14 wherein the bulk treating chemistry dispenser further comprises a dispensing hose fluidly coupled at an angle to the recirculation circuit downstream of a pump outlet of the recirculation pump.

18. The method of claim 17, further comprising a dosing coupler configured to fluidly couple the dispensing hose with a recirculation hose of the recirculation circuit at the angle.

19. The method of claim 18 wherein the rinse cycle or the cleaning cycle is configured to rinse at least one of: the at least one treating chemistry reservoir, the dispensing hose, the metering pump, or the dosing coupler.

20. The method of claim 1 wherein the rinse cycle or the cleaning cycle is configured to rinse at least one of the at least one treating chemistry reservoir, a liquid passage, a metering pump, or a dosing coupler.

* * * * *